US012091955B2

(12) United States Patent
Cornelssen et al.

(10) Patent No.: US 12,091,955 B2
(45) Date of Patent: Sep. 17, 2024

(54) FLUID COUPLING ASSEMBLIES FOR A MANIFOLD OF A HYDRAULIC FRACTURING SYSTEM AND RELATED METHODS

(71) Applicant: Scout Surface Solutions LLC, Joshua, TX (US)

(72) Inventors: Michael James Cornelssen, Joshua, TX (US); Christopher Mark Koch, Joshua, TX (US)

(73) Assignee: Scout Surface Solutions LLC, Joshua, TX (US)

( * ) Notice: Subject to any disclaimer, the term of this patent is extended or adjusted under 35 U.S.C. 154(b) by 0 days.

(21) Appl. No.: 18/545,946

(22) Filed: Dec. 19, 2023

(65) Prior Publication Data

US 2024/0209720 A1 Jun. 27, 2024

Related U.S. Application Data

(60) Provisional application No. 63/512,193, filed on Jul. 6, 2023, provisional application No. 63/512,219, filed on Jul. 6, 2023, provisional application No. 63/491,139, filed on Mar. 20, 2023, provisional application No. 63/476,438, filed on Dec. 21, 2022.

(51) Int. Cl.
*E21B 43/26* (2006.01)
*F04B 53/16* (2006.01)

(52) U.S. Cl.
CPC ..... *E21B 43/2607* (2020.05); *F04B 53/16* (2013.01)

(58) Field of Classification Search
CPC ..... E21B 43/2607; F04B 53/16
See application file for complete search history.

(56) References Cited

U.S. PATENT DOCUMENTS

| | | | |
|---|---|---|---|
| 5,018,769 | A | 5/1991 | Albrecht |
| 8,978,763 | B2 | 3/2015 | Guidry |
| 10,458,216 | B2 | 10/2019 | Hefley |
| 10,655,934 | B2 | 5/2020 | Flaster et al. |
| 10,982,522 | B1 | 4/2021 | Hill et al. |
| 10,995,561 | B1 | 5/2021 | Travix et al. |

(Continued)

FOREIGN PATENT DOCUMENTS

| | | |
|---|---|---|
| CA | 2638434 | 1/2010 |
| CN | 217401115 | 9/2022 |

OTHER PUBLICATIONS

USPTO Invitation to Pay Additional Fees for PCT/US2023/084996, Mar. 6, 2024.

(Continued)

*Primary Examiner* — P. Macade Nichols
(74) *Attorney, Agent, or Firm* — Womble Bond Dickinson (US) LLP

(57) ABSTRACT

Embodiments of a method include connecting an inner end of a base of a fluid coupling assembly to an outer surface of a manifold of a hydraulic fracturing system. The base includes an outer end opposite the inner end and a through-passage extending from the outer end to the inner end. In addition, the method includes inserting a coupling adapter into the through-passage from the outer end to compress the coupling adapter into the through-passage and to position a connection device of the coupling adapter outside of the through-passage at the outer end.

30 Claims, 25 Drawing Sheets

(56) References Cited

U.S. PATENT DOCUMENTS

| | | | | |
|---|---|---|---|---|
| 11,193,360 | B1 | 12/2021 | Yeung et al. | |
| 11,193,361 | B1 | 12/2021 | Yeung et al. | |
| 11,319,757 | B2 | 5/2022 | Robinson et al. | |
| 2004/0154790 | A1* | 8/2004 | Cornelssen | E21B 33/03 166/75.13 |
| 2007/0114039 | A1 | 5/2007 | Hobdy et al. | |
| 2012/0085532 | A1* | 4/2012 | McGuire | E21B 43/26 166/177.5 |
| 2017/0138144 | A1 | 5/2017 | Christopherson et al. | |
| 2019/0024829 | A1 | 1/2019 | Potier | |
| 2020/0103078 | A1 | 4/2020 | Scott et al. | |
| 2020/0109804 | A1 | 4/2020 | Nguyen | |
| 2021/0108758 | A1 | 4/2021 | Loven | |
| 2021/0388931 | A1 | 12/2021 | George et al. | |
| 2022/0049802 | A1 | 2/2022 | Choate et al. | |
| 2022/0186568 | A1 | 6/2022 | Westgarth | |
| 2023/0100479 | A1 | 3/2023 | Roesner et al. | |
| 2023/0119473 | A1 | 4/2023 | Roesner et al. | |

OTHER PUBLICATIONS

USPTO Invitation to Pay Additional Fees for PCT/US2023/084998, Mar. 6, 2024.

International Search Report and Written Opinion for international application No. PCT/US2023/084998, mailed on May 22, 2024.

International Search Report and Written Opinion for international application No. PCT/US2023/084996, mailed on May 22, 2024.

* cited by examiner

FLUID COUPLING ASSEMBLIES FOR A MANIFOLD OF A HYDRAULIC FRACTURING SYSTEM AND RELATED METHODS

CROSS REFERENCE TO RELATED APPLICATIONS

This application claims priority to, and the benefit of U.S. Provisional Application No. 63/512,219, filed Jul. 6, 2023, titled "FLUID COUPLING ASSEMBLIES FOR A MANIFOLD OF A HYDRAULIC FRACTURING SYSTEM AND RELATED METHODS," U.S. Provisional Application No. 63/512,193, filed Jul. 6, 2023, titled "FLOW CROSS JUNCTIONS FOR A MANIFOLD OF A HYDRAULIC FRACTURING SYSTEM AND RELATED METHODS," U.S. Provisional Application No. 63/491,139, filed Mar. 20, 2023, titled "FLOW CROSS JUNCTIONS FOR A MANIFOLD OF A HYDRAULIC FRACTURING SYSTEM AND RELATED METHODS," and U.S. Provisional Application No. 63/476,438, filed Dec. 21, 2022, titled "FLUID COUPLING ASSEMBLIES FOR A MANIFOLD OF A HYDRAULIC FRACTURING SYSTEM AND RELATED METHODS," the disclosures of which are incorporated herein by reference in their entireties. This application is also related to U.S. Non-Provisional application Ser. No. 18/545,963, filed Dec. 19, 2023, titled "FLOW CROSS JUNCTIONS FOR A MANIFOLD OF A HYDRAULIC FRACTURING SYSTEM AND RELATED METHODS," the disclosure of which is incorporated herein by reference in its entirety.

BACKGROUND

During a hydraulic fracturing operation, a pressurized fracturing fluid is injected into a subterranean formation via a wellbore or multiple wellbores. The injected fracturing fluid is at a higher pressure than the fracture pressure of the subterranean formation such that the fluid creates fractures therein. The fractures increase a permeability of the subterranean formation so that formation fluids (such as oil, gas, water, etc.) may more easily escape the subterranean formation and flow to the surface via the wellbore(s). Proppant (such as sand or other solids) may be mixed with the fracturing fluid prior to injecting the fracturing fluid downhole. The proppant may flow into the fractures in the subterranean formation to hold the fractures open after the hydraulic fracturing operation has ended.

Various fluid conveyance devices and systems are positioned at the surface to route the fracturing fluids into and out of the wellbore(s) during the hydraulic fracturing operation. The fluid conveyance devices may include various combinations of pipes, hoses, conduits, manifolds, tanks, pumps, etc. At least some of these devices transport the fracturing fluid after it has been pressurized into the wellbore(s). Thus, the fluid conveyance devices (or some of the fluid conveyance devices) are configured to withstand relatively high differential pressures during operations. However, due to the severe conditions of a hydraulic fracturing operation, failures of these fluid conveyance devices are common.

BRIEF SUMMARY

At least some embodiments disclosed herein are directed to fluid coupling assemblies for a manifold of a hydraulic fracturing system that facilitate quick replacement in the event of a failure so as to minimize stoppage time of the hydraulic fracturing system. In some embodiments, the embodiments disclosed herein include a fluid coupling assembly having a removable coupling adapter that is inserted within a base that is connected to the manifold. By configuring the coupling adapter so that it may be easily removed and replaced, the downtime associated with the replacement of a failed fluid coupling on the manifold may be reduced.

Some embodiments disclosed herein are directed to methods. In some embodiments disclosed herein, a method includes connecting an inner end of a base of a fluid coupling assembly to an outer surface of a manifold of a hydraulic fracturing system. The base includes an outer end opposite the inner end and a through-passage extending from the outer end to the inner end. In addition, the method includes inserting a coupling adapter into the through-passage from the outer end so as to compress the coupling adapter into the through-passage and to position a connection device of the coupling adapter outside of the through-passage at the outer end.

In some embodiments disclosed herein, a method includes inserting a coupling adapter into a through-passage of a base of a fluid coupling assembly. The base is connected to an outer surface of a manifold of a hydraulic fracturing system, and the coupling adapter includes a connection device that is to connect to an output of a pump of the hydraulic fracturing system. In addition, the method includes engaging an external shoulder of the coupling adapter with a retainer ring to restrict a rotation of the coupling adapter within the through-passage.

In some embodiments disclosed herein, a method includes removing a first coupling adapter from a through-passage of a base of a fluid coupling assembly. The base includes a first end and a second end opposite the first end, the second end is connected to a flow cross junction of a fluid manifold of a hydraulic fracturing system, and the through-passage extends from the first end to the second end. In addition, the method includes inserting a second coupling adapter into the through-passage from the first end so as to compress the second coupling adapter into the through-passage and to position a connection device of the second coupling adapter outside of the through-passage at the first end.

In some embodiments disclosed herein, a method includes unthreading a first coupling adapter from a through-passage of a base of a fluid coupling assembly. The base includes a first end, a second end opposite the first end, and a flange positioned more proximate the second end than the first end. The flange is connected to a flow cross junction of a fluid manifold of a hydraulic fracturing system, and the through-passage extends from the first end to the second end. In addition, the method includes removing the first coupling adapter from the through-passage at the first end of the base and inserting a second coupling adapter into the through-passage from the first end. Further, the method includes threading the second coupling adapter into the through-passage to position a connection device of the second coupling adapter outside of the through-passage at the first end of the base, and to fluidly connect a throughbore of the second coupling adapter to the flow cross junction via the through-passage.

Some embodiments disclosed herein are directed to a manifold of a hydraulic fracturing system. In some embodiments, the manifold includes an elongate manifold section, a flow cross junction connected to the elongate manifold section, and a fluid coupling assembly connected to the flow cross junction. The fluid coupling assembly includes a base including a first end, a second end opposite the first end, and a through-passage extending from the first end to the second end. The second end is connected to the flow cross junction. In addition, the fluid coupling assembly includes a coupling adapter including a connection device to connect to an output of a pump. The coupling adapter is removably inserted into the through-passage from the first end to compress the coupling adapter into the through-passage and to position the connection device outside of the through-passage at the first end.

Some embodiments disclosed herein are directed to a fluid coupling assembly for a manifold of a hydraulic fracturing system. In some embodiments, the fluid coupling assembly includes a base to connect to an outer surface of the manifold. The base includes a through-passage to fluidly connect to a flow path of the manifold. In addition, the fluid coupling assembly includes a coupling adapter removably inserted within the through-passage. The coupling adapter includes a connection device and an external shoulder. The connection device is to connect with an output of a pump of the hydraulic fracturing system. Further, the fluid coupling assembly includes a retainer ring connected to the base and compressed against the external shoulder to restrict a rotation of the coupling adapter within the through-passage.

Some embodiments disclosed herein are directed to a kit. In some embodiments, the kit includes a container and a coupling adapter positioned within the container. The coupling adapter includes a central axis, a first end, a second end opposite the first end, and an outer surface. The outer surface includes a first connection device positioned more proximate the first end than the second end. The first connection device is to fluidly connect to an output of a pump of a hydraulic fracturing system. In addition, the outer surface includes a second connection device spaced from the first connection device and positioned more proximate the second end than the first end. The second connection device is to be removably engaged within a through-passage connected to a manifold of the hydraulic fracturing system. In addition, the kit includes a gasket positioned within the container. The gasket is configured to be compressed between the second end of the coupling adapter and an internal shoulder formed within the through-passage.

Embodiments described herein comprise a combination of features and characteristics intended to address various shortcomings associated with certain devices, systems, and methods. The foregoing has outlined rather broadly the features and technical characteristics of some of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

As previously described, during a hydraulic fracturing operation, various fluid conveyance devices may be used to route and contain relatively high-pressure fracturing fluid during operations. For instance, one such fluid conveyance device includes a fluid manifold for receiving the pressurized fluid from one or more pumps. Such manifolds are sometimes referred to as "missiles." The manifold may include one or more fluid inlets for receiving the pressurized fluid output from the one or more pumps. Each inlet may include a fluid coupling that connects to an output of a corresponding pump via a suitable conduit. Such fluid couplings represent a weak point in the manifold and routinely experience failure due to the high pressures of the fracturing fluid, the vibrations within the system (such as vibrations caused by operation of the pump(s)), and the erosive nature of the proppant entrained within the high-pressure fracturing fluid. However, removal and replacement of these fluid couplings can be cumbersome and time consuming. Thus, a failure of a fluid coupling on the high-pressure manifold can lead to a significant delay in the hydraulic fracturing operation and an associated increase in the cost and time associated with the hydraulic fracturing operation.

Accordingly, the embodiments disclosed herein include fluid coupling assemblies for a manifold of a hydraulic fracturing system that facilitate quick replacement in the event of a failure so as to minimize stoppage time. In some embodiments, the embodiments disclosed herein include a fluid coupling assembly having a removable coupling adapter that is inserted within a base that is connected to the manifold. As will be described in more detail below, the coupling adapter may be the component of the fluid coupling assembly having the highest likelihood of failure. Thus, by configuring the coupling adapter so that it may be easily removed and replaced, the downtime associated with the replacement of a failed fluid coupling on the manifold may be reduced. As a result, through use of the embodiments disclosed herein, a hydraulic fracturing operation may be conducted more safely and efficiently.

Figure 1:
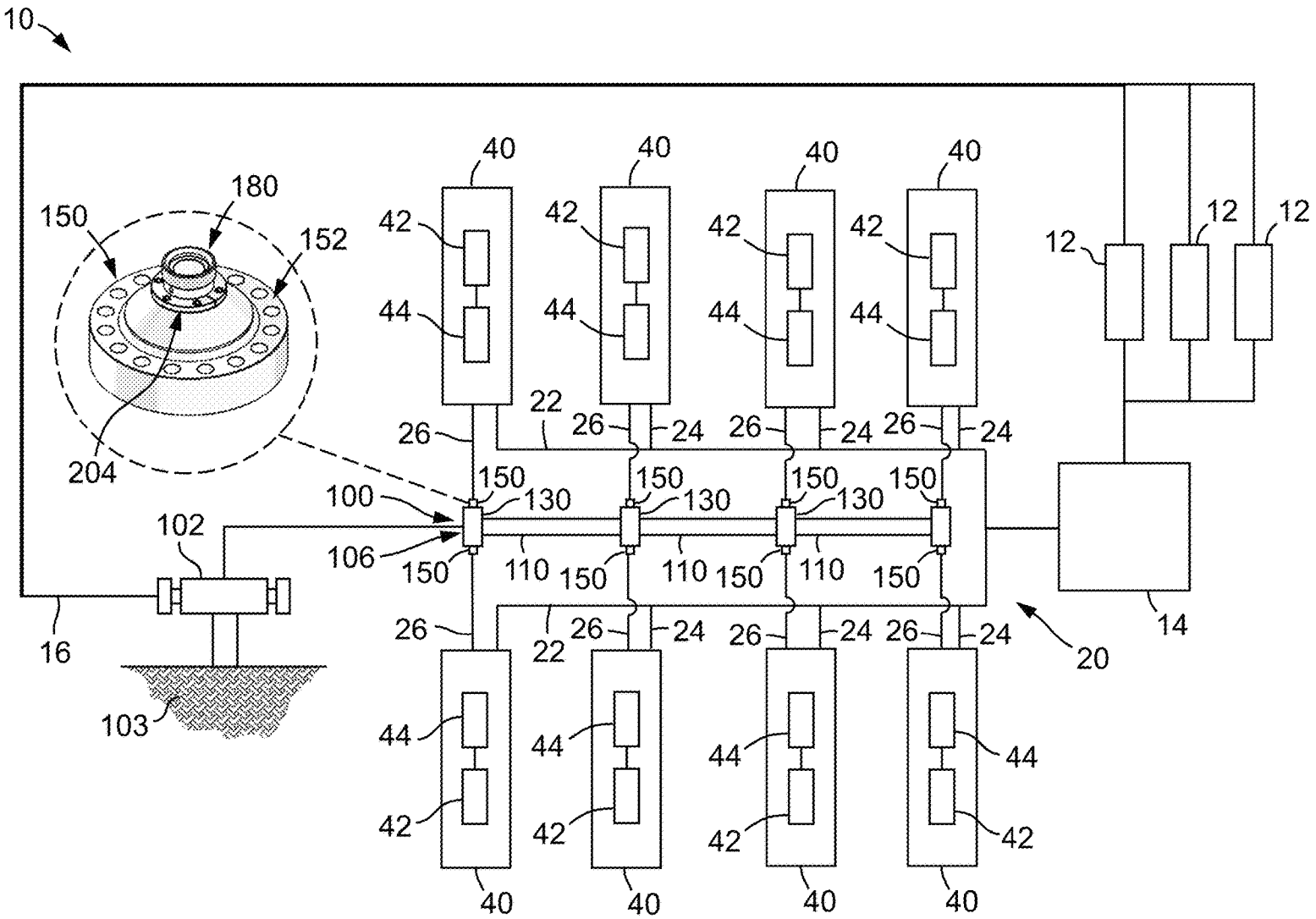
FIG. 1 is a schematic diagram of a hydraulic fracturing system including a manifold having one or more fluid coupling assemblies according to some embodiments of the disclosure.

FIG. 1 illustrates a schematic diagram of a hydraulic fracturing system 10 including a manifold 100 having one or more fluid coupling assemblies 150 according to some embodiments. During operations, system 10 may inject a high-pressure fracturing fluid into a wellhead 102 that is connected to a wellbore (not shown) extending into a subterranean formation 103 to fracture the subterranean formation 103 as previously described. In some embodiments, the system may inject the high-pressure fracturing fluid into a plurality of wellheads so as to access the subterranean formation 103 via a plurality of wellbores.

It should be appreciated that the hydraulic fracturing system 10 shown in FIG. 1 depicts some components and assemblies that may be used during a hydraulic fracturing operations, and that in some embodiments additional or fewer components may be used within the system 10. Thus, the particular combination and/or arrangement of components of the system 10 depicted in FIG. 1 is not limiting to other potential embodiments of system 10.

System 10 generally includes a plurality of storage vessels 12 that are each configured to hold a volume of fracturing fluid therein. The fracturing fluid stored in the storage vessels 12 may include any liquid or semi-liquid (such as a gel) that is suitable for injection into and fracturing of the subterranean formation 103 as previously described. In some embodiments, the fracturing fluid includes an aqueous solution including substantially pure water or water mixed with one or more additives (such as gels, gelling agents, chemicals, etc.). The storage vessels 12 may include any suitable container for holding a volume of fluids (such as liquids) therein. For instance, in some embodiments, storage vessels may include rigid tanks, flexible tanks (such as bladders), open pits, mobile tanks (that may be pulled by a tractor trailer or other vehicle), or a combination thereof.

As shown in FIG. 1, a blender 14 is positioned downstream of the storage vessels 12 that is configured to mix a proppant into the fracturing fluid. The proppant may include sand or other suitable solids. As previously described, the proppant is configured to flow into the fractures within the subterranean formation 103 so as to hold the fractures open after the hydraulic fracturing operation has ended. In some embodiments, additives (such as chemical additives) may be mixed into the fracturing fluid within the blender 14 either in addition or alternatively to the proppant. The blender 14 emits the fracturing fluid, now with proppant mixed therein, to a manifold assembly 20 that communicates the fracturing fluid to and from a plurality of pumping units 40.

Specifically, the manifold assembly 20 includes one or more low-pressure, inlet manifolds 22 and one or more high-pressure, outlet manifolds 100. In the particular embodiment depicted in FIG. 1, manifold assembly 20 includes two inlet manifolds 22 and a single outlet manifold 100. However, in other embodiments, different members, arrangements, and combinations of inlet manifolds 22 and outlet manifolds 100 may be utilized, such as, for instance, a single outlet manifold 100, a plurality of outlet manifolds 100, a single inlet manifold 22, or a plurality of inlet manifolds 22. A plurality of inlet conduits 24 connect the inlet manifolds 22 to the plurality of pumping units 40. In addition, a plurality of outlet conduits 26 connect the plurality of pumping units 40 to the outlet manifold 100.

Each pumping unit 40 includes a pump 44 driven by a driver 42 (which may be referred to herein as a "prime mover"). Pump 44 may include any suitable fluid pumping device or assembly for pressurizing the fracturing fluid (with or without proppant and/or other additives entrained therein) to the pressures associated with a hydraulic fracturing operation. For instance, in some embodiments, the pump 44 may be configured to pressurize the fracturing fluid (again, with or without proppant and/or other additives entrained therein) to a pressure of about 9000 pounds per square inch (psi) or higher. Thus, pump 44 may be referred to herein as a "hydraulic fracturing pump" 44. In some embodiments, pump 44 may include a positive displacement pump, centrifugal pump, or other suitable pump types. Driver 42 may include any suitable motor or engine that is configured to drive or actuate the corresponding pump 44 during operations. For instance, in some embodiments, driver 42 may include a diesel engine, a turbine (such as a gas turbine, steam turbine, etc.), an electric motor, or some combination thereof. During operations, within each pumping unit 40, the driver 42 may actuate the pump 44 to drawn fracturing fluid into the pump 44 via the corresponding inlet conduit 24 and to pressurize and output the fracturing fluid from the pump 44 via the corresponding outlet conduit 26.

The outlet manifold 100 is described in more detail below. However, generally speaking the pressurized fracturing fluid is received by the outlet manifold 100 via the outlet conduits 26. The outlet manifold 100 directs the pressurized fracturing fluid toward the wellhead 102 such that it may access the subterranean formation 103 as previously described. During the hydraulic fracturing operations, fracturing fluid may be emitted from the wellbore via the wellhead 102 and recycled back to the storage vessels 12 through one or more recycle conduits 16. In some embodiments, the fracturing fluid output from the wellhead 102 may be routed through one or more filtering or separation assemblies or devices (not shown) to remove additives, proppant, and/or other fluids or solids (such as rock chips, formation fluids, etc.) that may be entrained within the fracturing fluid, prior to recycling the fracturing fluid to the storage vessels 12.

Figure 2:
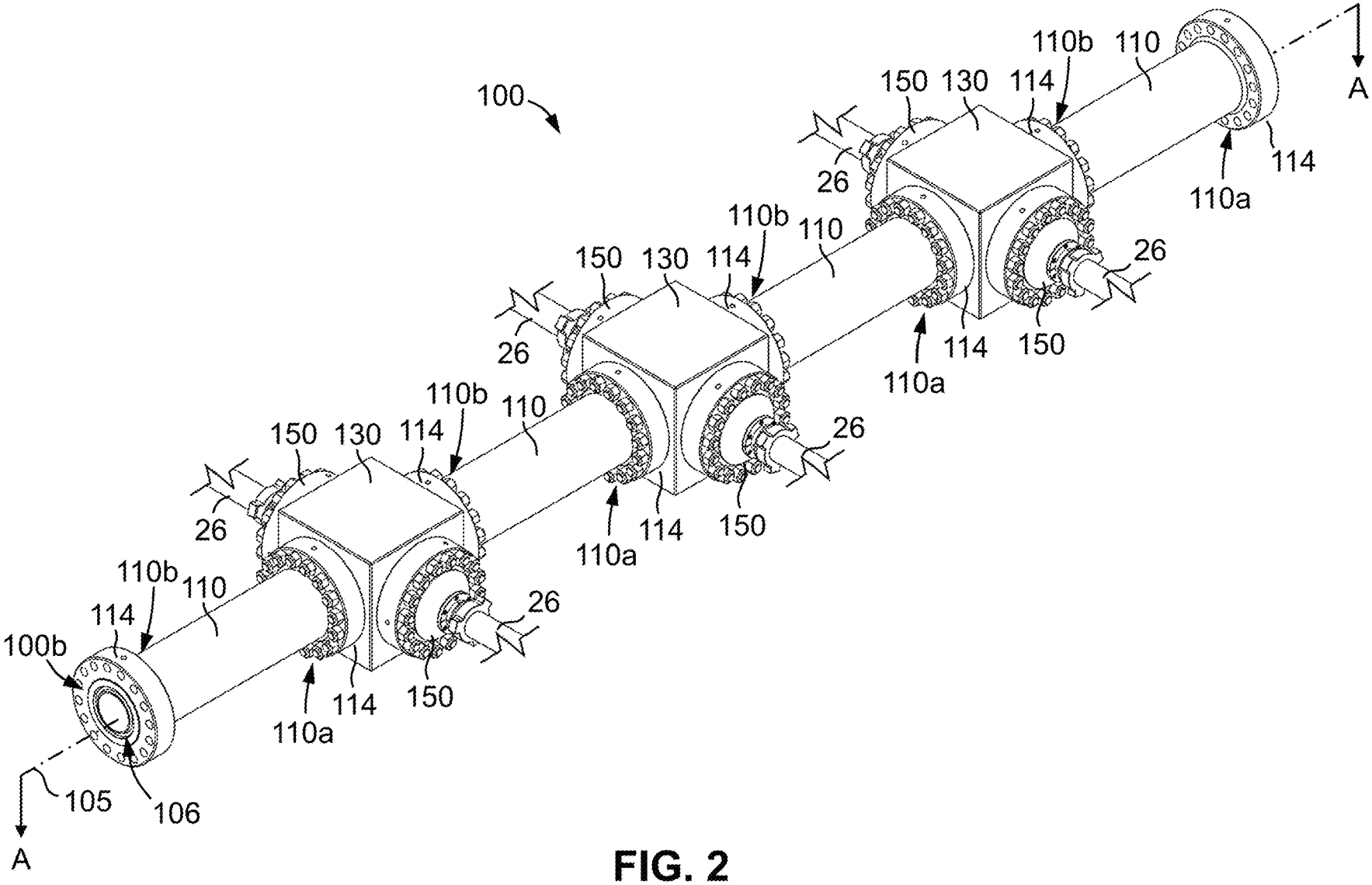
FIG. 2 is a schematic perspective view of an outlet manifold of the hydraulic fracturing system of FIG. 1 according to some embodiments of the disclosure.
Figure 3:
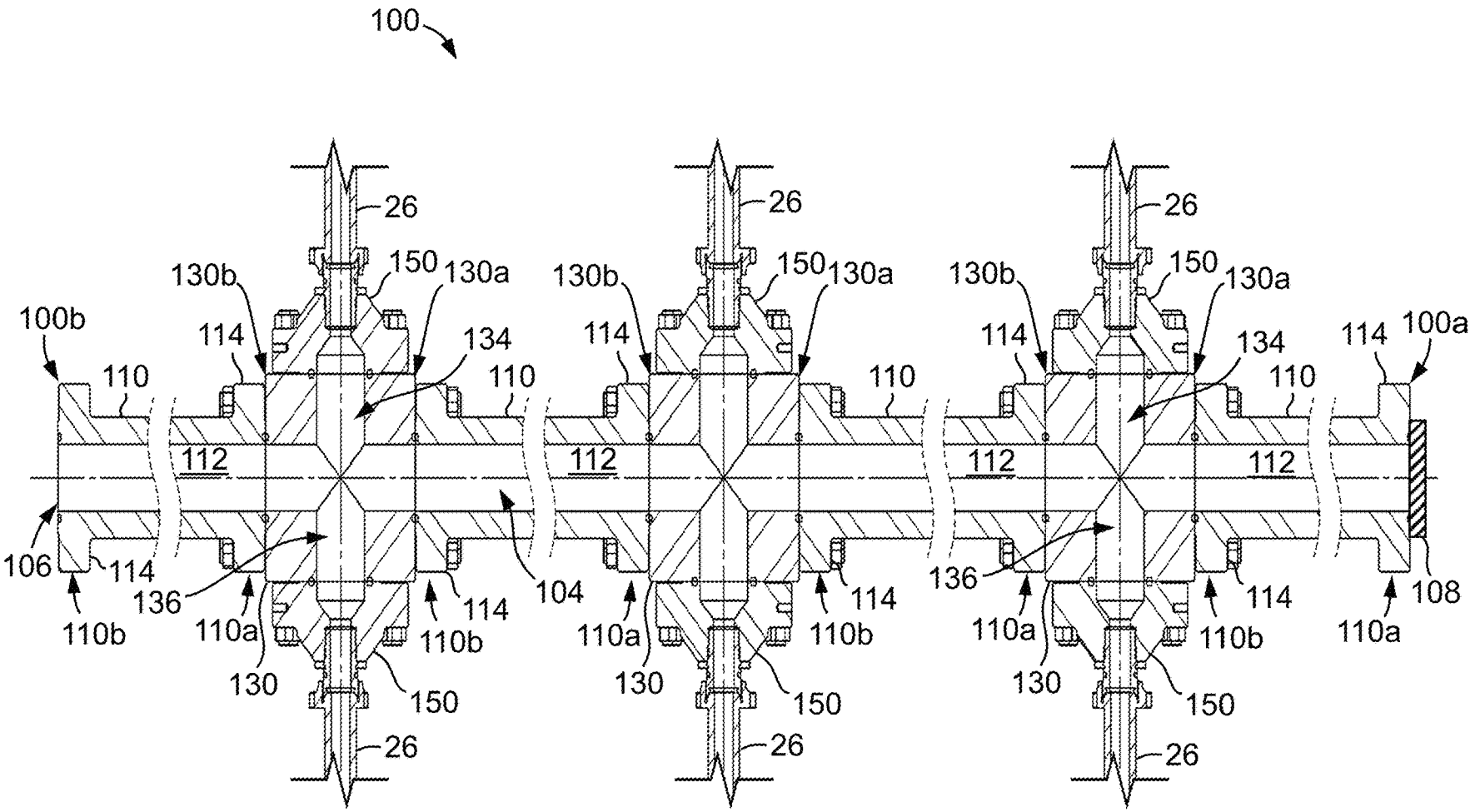
FIG. 3 is a cross-sectional view of the manifold of FIG. 2 taken along section A-A in FIG. 2 according to some embodiments of the disclosure.

FIGS. 2 and 3 show an outlet manifold 100 of the hydraulic fracturing system 10 of FIG. 1 according to some embodiments. Outlet manifold 100 is an elongate member having a central or longitudinal axis 105, a first or upstream end 100*a*, and a second or downstream end 100*b* opposite upstream end 100*a*. As used herein, the terms "upstream" and "downstream" are used to denote the general direction of flow of fracturing fluid through the outlet manifold 100 during operations, according to some embodiments. This convention is used herein for clarity and convenience when describing the outlet manifold 100 and the components and assemblies thereof. An outlet 106 is positioned at the downstream end 100*b* that is fluidly connected to the wellhead 102 (FIG. 1).

In addition, outlet manifold 100 includes a plurality of tubular manifold sections 110 and a plurality of flow cross junctions 130 interleaved between the plurality of manifold sections 110 along the longitudinal axis 105. More particularly, each manifold section 110 extends axially between axially adjacent flow cross junctions 130.

Manifold sections 110 are elongate tubular members that are coaxially aligned along the longitudinal axis 105. As is best shown in FIG. 3, each manifold section 110 includes a first or upstream end 110*a*, a second or downstream end 110*b* opposite upstream end 110*a*, and a throughbore 112 extending axially between the ends 110*a*, 110*b*. Each end 110*a*, 110*b* is connected to an axially adjacent flow cross junction 130 along outlet manifold 100. For instance, referring briefly to FIG. 4, the ends 110*a*, 110*b* of each manifold section 110 may be connected to a corresponding, axially adjacent flow cross junction 130 via flanges 114; however, other connection mechanisms are contemplated (such as a threaded connection, clamped connection, welded connection, etc.).

Figure 4:
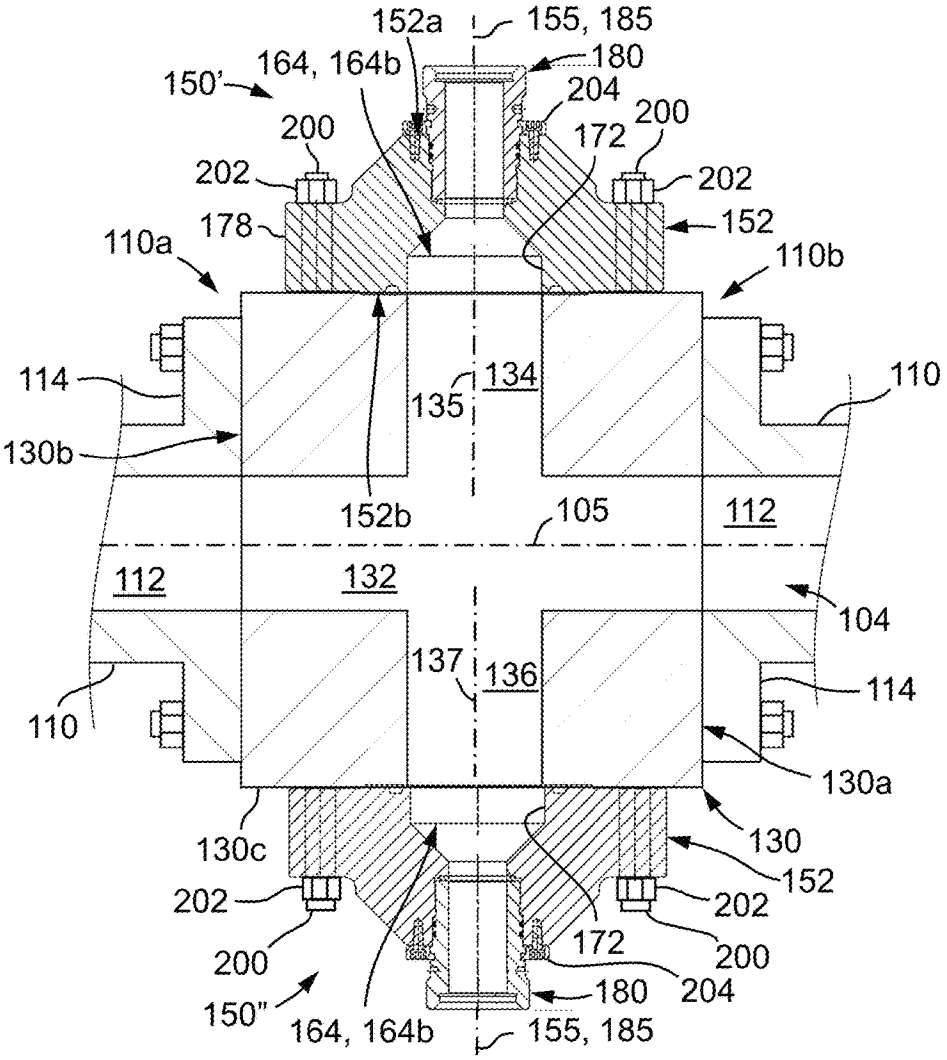
FIG. 4 is an enlarged cross section of one of the flow cross junctions of the manifold of FIG. 2 according to some embodiments of the disclosure.

As shown in FIGS. 2-4, flow cross junctions 130 are axially spaced along longitudinal axis 105 and axially interleaved between the plurality of manifold sections 110 as previously described. During operations, the flow cross junctions 130 provide a plurality of inlets for pressurized fracturing fluid to enter the outlet manifold 100 during operations. Each flow cross junction 130 includes a first or upstream end 130*a*, a second or downstream end 130*b* opposite upstream end 130*a*, and a radially outer surface 130*c* extending axially between ends 130*a*, 130*b*. In some embodiments, the flow cross junctions 130 may have a rectangular cross-section along a plane extending radially through the longitudinal axis 105, such that the ends 130*a*, 130*b* and radially outer surface 130*c* may define a cubic-shape for each flow cross-junction 130.

A first or main flow bore 132 extends axially between the ends 130*a*, 130*b*. As best shown in FIG. 3, the main flow bores 132 of flow cross junctions 130 are aligned and fluidly connected with the throughbores 112 of the axially adjacent manifold sections 110 along outlet manifold 100 such that the throughbores 112 and main flow bores 132 together define a manifold flow path 104 that extends through the outlet manifold 100 between the upstream end 100*a* and the downstream end 100*b* (and outlet 106).

As shown in FIG. 3, in some embodiments, the manifold flow path 104 may be blocked by a blind or cap 108 at the upstream end 100*a* of outlet manifold 100 so that fracturing fluid may not flow out of outlet manifold 100 via the upstream end 100*a* of outlet manifold 100. In the embodiment shown in FIG. 3, the upstream end 100*a* is defined by an upstream end 110*a* of one of the manifold sections 110. In some embodiments, the upstream end 100*a* of outlet manifold 100 may be defined by an upstream end 130*a* of one of the flow cross junctions 130 (such as the most upstream of the flow cross junctions 130). In some of these embodiments, the main flow bore 132 of the flow cross junction 130 defining or including the upstream end 100*a* of outlet manifold 100 may not extend fully to upstream end 100*a* (and the corresponding upstream end 130*a*) and cap 108 may be omitted. In addition, the downstream end 100*b* of outlet manifold 100 may define the outlet 106 of the manifold flow path 104. Specifically, in some embodiments, the downstream end 100*b* is defined by a downstream end 110*b* of one of the manifold sections 110. In some embodiments, the downstream end 100*b* may be defined by a downstream end 130*b* of one of the flow cross junctions 130 (such as the most downstream of the flow cross junctions 130).

In addition, each flow cross junction 130 includes a plurality of inlet flow bores 134, 136 that extend from the radially outer surface 130*c* to the main flow bore 132. For instance, as shown in FIGS. 3 and 4, in some embodiments, a first inlet flow bore 134 and a second inlet flow bore 136 each extend radially from radially outer surface 130*c* to main flow bore 132. The inlet flow bores 134, 136 of the flow cross junctions 130 provide inlet flow paths into the manifold flow path 104 for the fracturing fluid output from the plurality of pumping units 40 via outlet conduits 26 during operations (FIG. 1).

Referring specifically to FIG. 4, the first inlet flow bore 134 extends along a first axis 135 and the second inlet flow bore 136 extends along a second axis 137. The first axis 135 and the second axis 137 (and thus also the first inlet flow bore 134 and the second inlet flow bore 136, respectively) are radially opposite one another about the longitudinal axis 105, and each axis 135, 137 extends radially with respect to longitudinal axis 105. Thus, the axes 135, 137 are aligned along a common radially extending plane relative to longitudinal axis 105. In some embodiments, axes 135, 137 may be axially offset from one another along longitudinal axis 105 such the axes 135, 137 lie in different radially extending planes relative to longitudinal axis 105. In addition, in some embodiments, one or both of the axes 135, 137 may not extend radially relative to longitudinal axis 105. For instance, one or both of the axes 135, 137 (and thus also the inlet flow bores 134, 136, respectively) may extend at an angle (such as at an acute angle) relative to the longitudinal axis 105. In addition, in some embodiments, one or both of the inlet flow bores 134, 136 may be curved.

As shown in FIGS. 1-3, the outlet manifold 100 also includes a plurality of fluid coupling assemblies 150 that are mounted to the radially outer surfaces 130*c* of the flow cross junctions 130. As will be described in more detail below, the fluid coupling assemblies 150 provide connections for the outlet conduits 26 to thereby fluidly connect the outlet manifold 100 to the plurality of pumping units 40 (particularly pumps 44). Further details of embodiments of the fluid coupling assemblies 50 are provided below.

Figure 5:
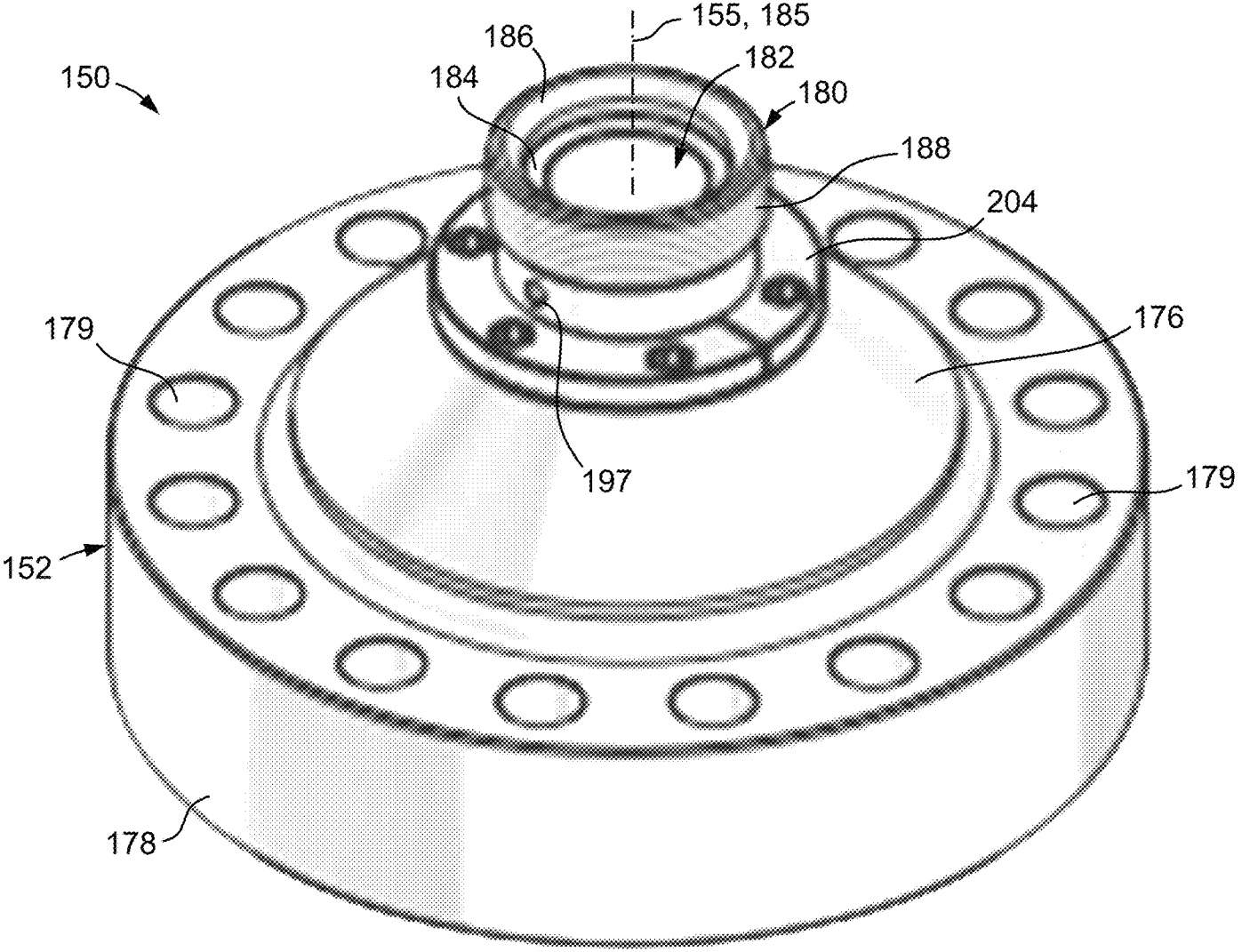
FIG. 5 is a perspective view of a fluid coupling assembly having a removable coupling adapter according to some embodiments of the disclosure.
Figure 6:
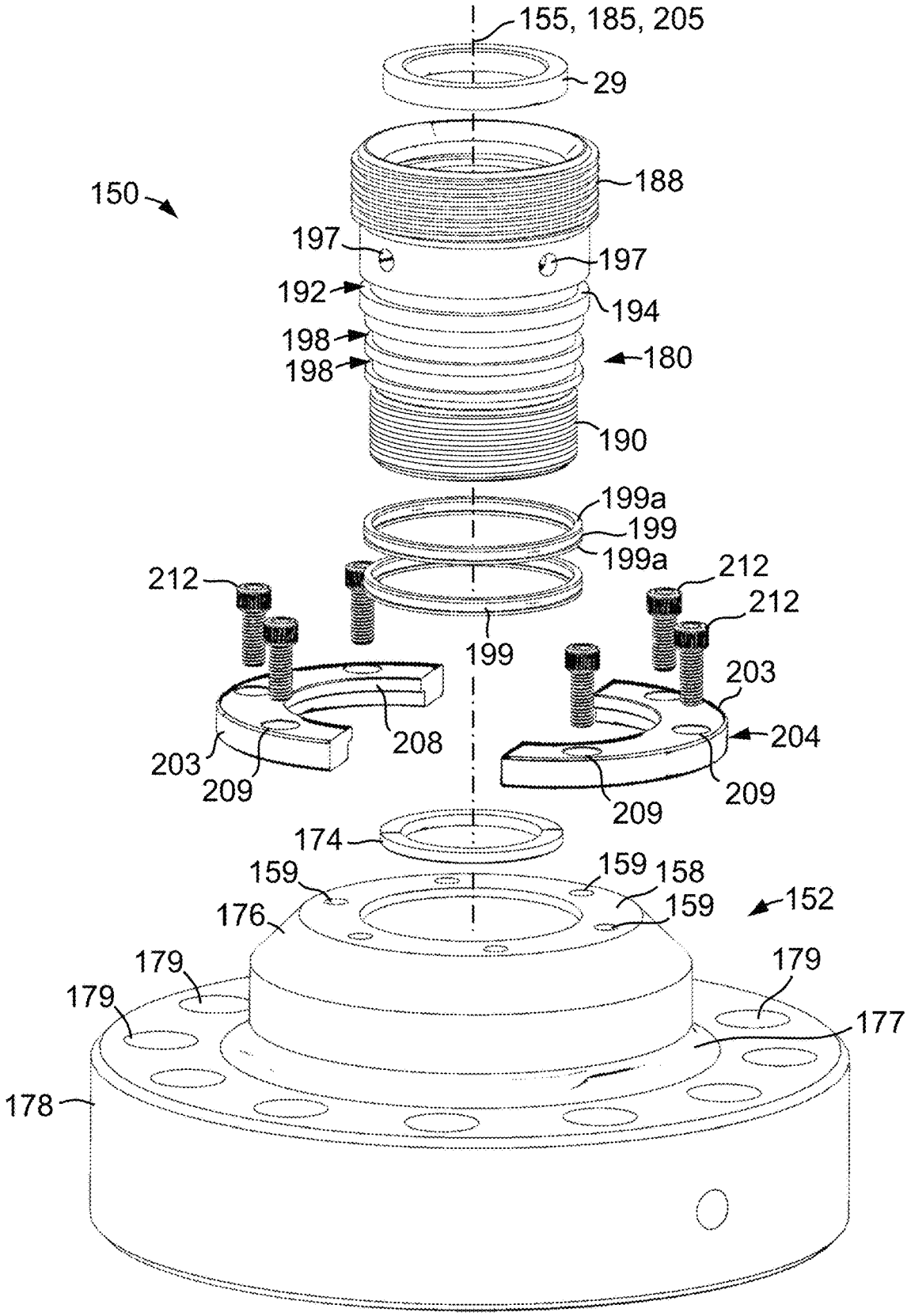
FIG. 6 is an exploded perspective view of the coupling assembly of FIG. 5 according to some embodiments of the disclosure.
Figure 7:
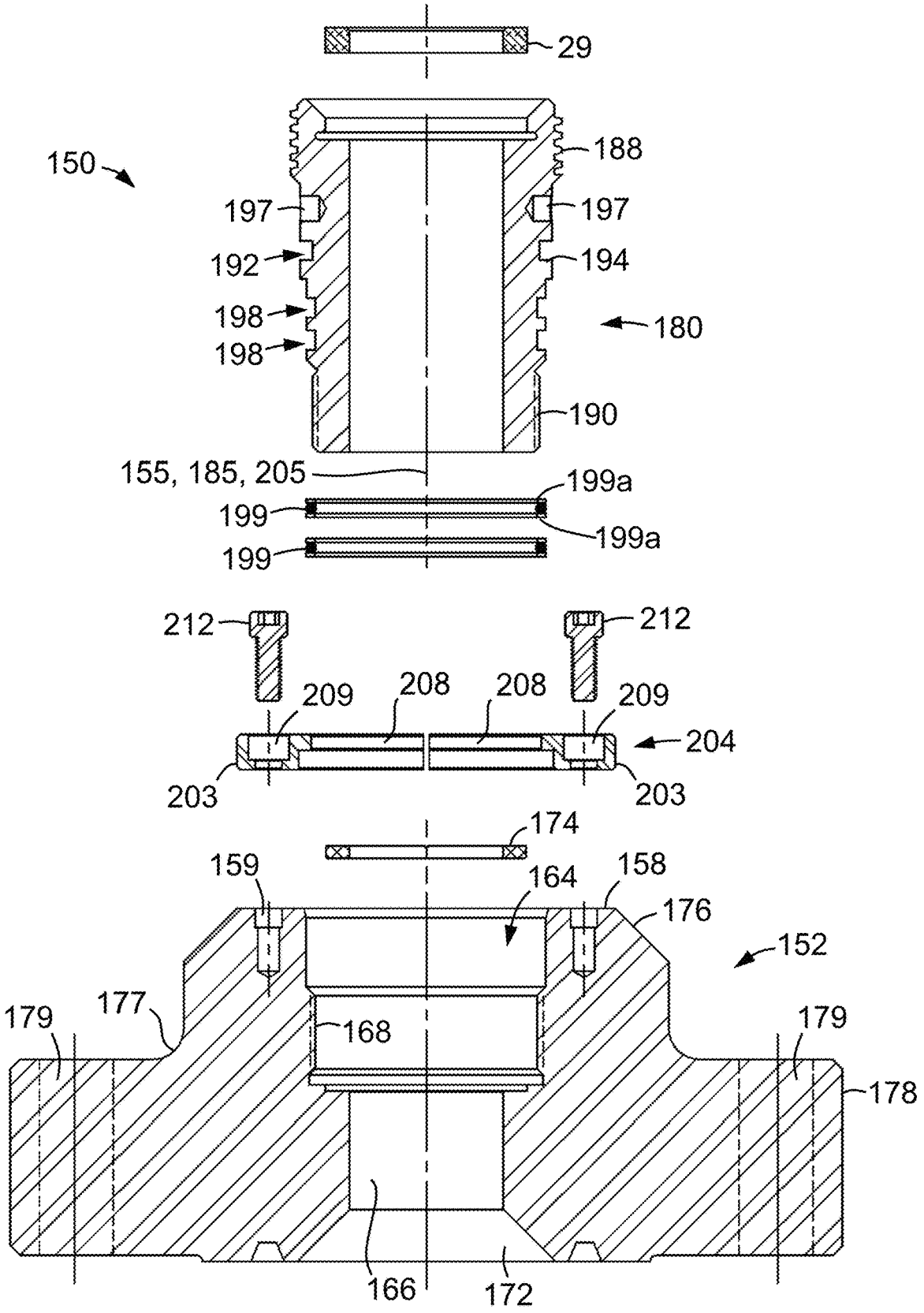
FIG. 7 is an exploded side cross sectional view of the coupling assembly of FIG. 5 according to some embodiments of the disclosure.

FIG. 5 shows a perspective view of one of the coupling assemblies 150 according to some embodiments. In addition, FIGS. 6 and 7 show perspective and cross-sectional exploded views, respectively, of the coupling assembly of FIG. 5 according to some embodiments. The coupling assembly 150 includes a base 152 that is connected to one of the flow cross junctions 130 (FIGS. 1-4) and a coupling adapter 180 that is removably inserted within and extended outward from the base 152 such that (as is described in more detail below) coupling adapter 180 may be readily removed and replaced in the event of a failure without disconnecting the base 152 from the corresponding flow cross junction 130. As a result, the connection between the flange 178 and flow cross junction 130 may be maintained during removal of coupling adapter 180, and the removal of the coupling adapter 180 is independent of the connection between the flange 178 and flow cross junction 130. Further details of embodiments of the base 152 and coupling adapter 180 are provided below.

Figure 8:
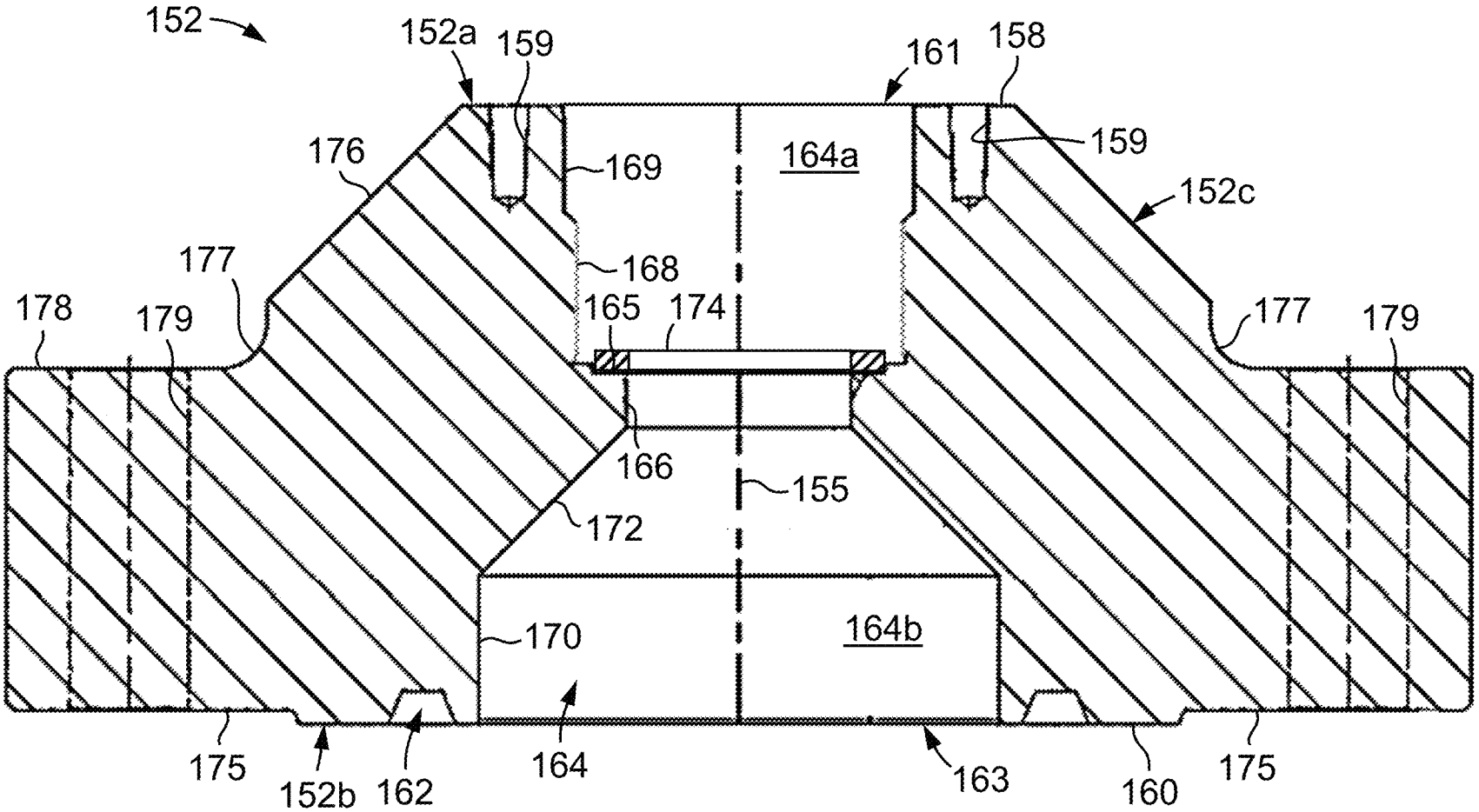
FIG. 8 is a side, cross-sectional view of a base of the fluid coupling assembly of FIG. 5 according to some embodiments of the disclosure.

FIG. 8 shows a side cross-section of base 152 of one of the fluid coupling assemblies 150 according to some embodiments. Base 152 includes a central axis 155, a first end 152*a*, and a second end 152*b* opposite first end 152*a*. As shown in FIG. 4, the second end 152*b* engages with radially outer surface 130*c* of a corresponding one of the flow cross junctions 130, and the first end 152*a* is projected outward or away from the flow cross junction 130 along the central axis 155. Thus, first end 152*a* may be referred to herein as the outer end 152*a* of the base 152 and the second end 152*b* may be referred to as the inner end 152*b* of the base 152. As shown in FIG. 8, base 152 also includes a radially outer surface 152*c* and a through-passage 164 each extending between ends 152*a*, 152*b*.

Through-passage 164 extends axially through the base 152 along central axis 155 from the outer end 152*a* to the inner end 152*b*. Thus, the through-passage 164 has a first or outer opening 161 positioned at the outer end 152*a* and a second or inner opening 163 positioned at the inner end 152*b*. An internal shoulder 166 is formed within the through-passage 164. The internal shoulder 166 extends radially inward toward the central axis 155 and circumferentially about the central axis 155 within the through-passage 164. The internal shoulder 166 is axially spaced between the outer end 152*a* and the inner end 152*b* such that the internal shoulder 166 separates the through-passage 164 into a first or outer portion 164*a* extending axially from the outer end 152*a* (and outer opening 161) to the internal shoulder 166 and a second or inner portion 164*b* extending axially from the internal shoulder 166 to the inner end 152*b* (and inner opening 163).

The outer portion 164*a* of through-passage 164 includes a cylindrical surface 169 extending axially from outer end 152*a* and outer opening 161 along axis 155 and internal threads 168 positioned axially between the cylindrical surface 169 and the internal shoulder 166. Internal threads 168 may include one or more grooves that extend radially into through-passage 164 and helically about the central axis 155.

A radially extending circumferential ledge or seat 165 is formed on the internal shoulder 166 within the outer portion 164*a*. A gasket 174 (or junk ring) may be positioned on the seat 165 that may sealingly engage both the internal shoulder 166 and the coupling adapter 180 (FIGS. 5 and 8) to prevent or at least restrict the leakage of fracturing fluid out of the through-passage 164, between the coupling adapter 180 and the base 152 during operations. In some embodiments, the gasket 174 may comprise a compressible or crushable material that may form a seal to at least partially restrict the leakage of fracturing fluid out of the through-passage 164.

Inner portion 164*b* includes a cylindrical surface 170 extending axially from inner end 152*b* and inner opening 163. The cylindrical surface 170 and inner opening 163 may have an inner diameter that is greater than a minimum inner diameter of the internal shoulder 166. As a result, the inner portion 164*b* includes may include a frustoconical surface 172 that has an increasing inner diameter when moving from the internal shoulder 166 to the cylindrical surface 170. Specifically, the inner diameter of the cylindrical surface 170 and inner opening 163 may be chosen to match or correspond with an inner diameter of an inlet flow bore (such as inlet flow bores 134, 136) of the corresponding flow cross junction 130 (FIG. 4). Thus, in some embodiments, the shape, size, and arrangement of the inner portion 164*b* of the through-passage 164 (including the size, shape, arrangement of the cylindrical surface 170 and the frustoconical surface 172) may be varied in some embodiments. For instance, as is shown in FIG. 7, in some embodiments, shoulder 166 may be expanded axially along axis 155, and inner portion 164*b* may include the frustoconical surface 172 extending from the shoulder 166 and inner end 152*b* (and thus omits the cylindrical surface 170 shown in FIG. 8). In some embodiments, the frustoconical surface 172 may be referred to as a chamfer.

As shown in FIG. 8, an outer end face 158 is defined and positioned on the outer end 152*a*. The outer end face 158 may be a planar surface that extends radially relative to central axis 155 and circumferentially about the outer opening 161 of through-passage 164. A plurality of mounting bores 159 extend axially into the base 152 from the outer end face 158. The mounting bores 159 may be threaded (at least partially) such that they may receive one or more threaded mounting members (such as, for instance, mounting members 212 described herein) during operations. In some embodiments, mounting bores 159 may be evenly circumferentially spaced about axis 155 along the outer end face 158.

In addition, an inner end face 160 is defined and positioned on the inner end 152*b*. The inner end face 160 may be a planar surface that extends radially relative to central axis 155 and circumferentially about the inner opening 163 of through-passage 164. An annular groove or recess 162 is formed on the inner end face 160. The recess 162 extends axially into inner end face 160 and circumferentially about the central axis 155. During operations, an annular seal member (such as a gasket, seal ring, etc.—not shown) may be inserted within the recess 162 and compressed against the radially outer surface 130*c* (FIG. 4) of the corresponding flow cross junction 130 to prevent or at least restrict the leakage of fracturing fluid between the inner end 152*b* and radially outer surface 130*c* of the flow cross junction 130 during operations.

As shown in FIG. 8, the radially outer surface 152*c* includes a tapered or frustoconical surface 176 that extends from outer end 152*a* (and outer end face 158) toward inner end 152*b* and a flange 178 positioned between frustoconical surface 176 and inner end face 160. Frustoconical surface 176 tapers outward when moving axially from outer end 152*a* toward inner end 152*b*, such that an outer diameter of base 152 increases when moving axially from outer end 152*a* toward inner end 152*b* and flange 178 along frustoconical surface 176. In some embodiments, frustoconical surface 176 may be referred to as a chamfer.

Flange 178 extends radially outward from axis and frustoconical surface 176 and includes a plurality of mounting bores 179 extending axially through flange 178 that are circumferentially spaced about central axis 155. In some embodiments, the mounting bores 179 may be evenly circumferentially spaced about central axis 155. As will be described in more detail below, the mounting bores 179 may receive elongate mounting members (such as bolts, threaded studs, etc.) to secure the base 152 to the corresponding flow cross junction 130 (FIG. 4). In some embodiments, the inner end face 160 may be axially projected from an inner-most surface 175 of the flange 178 as shown in FIG. 6; however, in other embodiments, inner end face 160 may be co-planar (or flush) with or axially recessed inward from an inner-most surface 175 of the flange 178. The flange 178 may be positioned axially closer (and more proximate) to the inner end 152*b* than the outer end 152*a*. In some embodiments, the flange 178 may be positioned at the inner end 152*b* (such as when the inner end face 160 is co-planar with or recessed into the inner-most surface 175 of flange 178).

A radius 177 may be positioned axially between frustoconical surface 176 and flange 178. Without being limited to this or any other theory, radius 177 may avoid (or reduce) a stress riser at the transition between the frustoconical surface 176 and may simplify the manufacturing process for base 152 (such as by avoiding a sharp inset corner between frustoconical surface 176 and flange 178).

In some embodiments, the base 152 may be formed as a single-piece monolithic body, such as a single-piece metallic monolithic body. For instance, in some embodiments, the base 152 may be generally manufactured via a casting process, whereby one or more of the shapes, surfaces, and features (such as through-passage 164, internal shoulder 166, mounting bores 159, 179, recess 162, etc.) may be machined or cut into the casted base 152.

As shown in FIG. 4, the flange 178 of base 152 may be connected to the radially outer surface 130*c* of a corresponding flow cross junction 130 along outlet manifold 100 (FIGS. 1 and 2) during operations. In particular, a plurality of elongate connection members 200 may be engaged with flow cross junction 130 and extended through the mounting bores 179 of flange 178. In some embodiments, the connection members 200 may include threaded studs that are threadably engaged within the flow cross junction 130. A threaded nut 202 may be threadably engaged with each connection member 200 and torqued against the flange 178 so that flange 178 and inner end face 160 (FIG. 6) may be compressed into the radially outer surface 130*c* of flow cross junction 130.

As is also shown in FIG. 4, the base 152 of each coupling assembly 150 may be connected to the corresponding flow cross junction 130 such that the through-passage 164, and particularly the inner portion 164*b* of through-passage 164 is aligned with a corresponding one of the inner flow bores 134, 136. Specifically, a first coupling assembly 150' shown in FIG. 4 is connected to the flow cross junction 130 such that the cylindrical surface 172 of inner portion 164*b* of through-passage 164 of the base 152 of first coupling assembly 150' is aligned with the first inner flow bore 134, and a second coupling assembly 150" shown in FIG. 4 is connected to the flow cross junction 130 such that the cylindrical surface 172 of inner portion 164*b* of through-passage 164 of base 152 of second coupling adapter 150" is aligned with the second inner flow bore 136. As a result, the central axis 155 of the base 152 of first fluid coupling assembly 150' is aligned with the first axis 135 of first inner flow bore 134, and the central axis 155 of the base 152 of the second fluid coupling assembly 150" is aligned with the second axis 137 of second inner flow bore 136.

Figure 9:
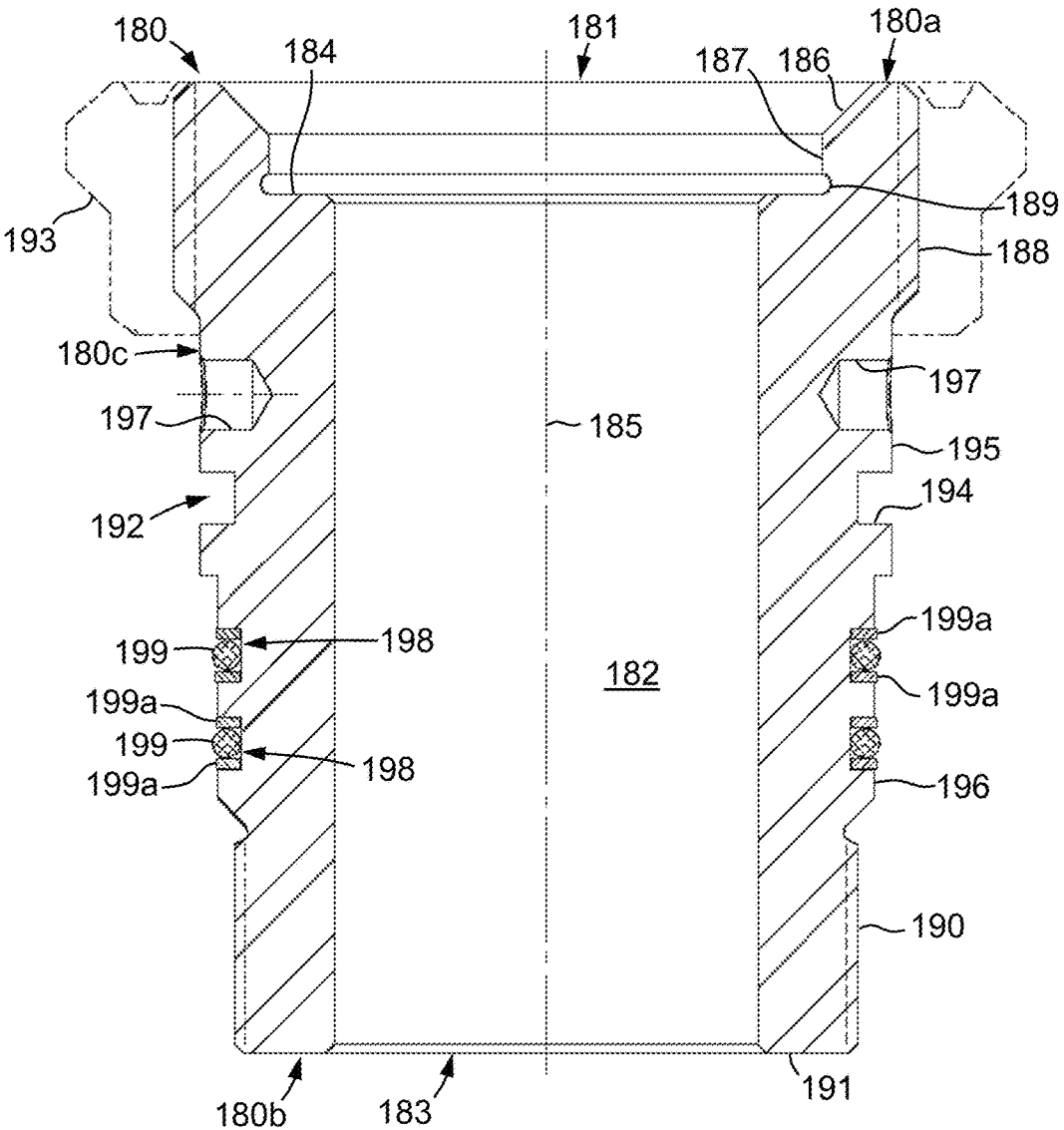
FIG. 9 is a side, cross-sectional view of the coupling adapter of the fluid coupling assembly of FIG. 5 according to some embodiments of the disclosure.
Figure 10:
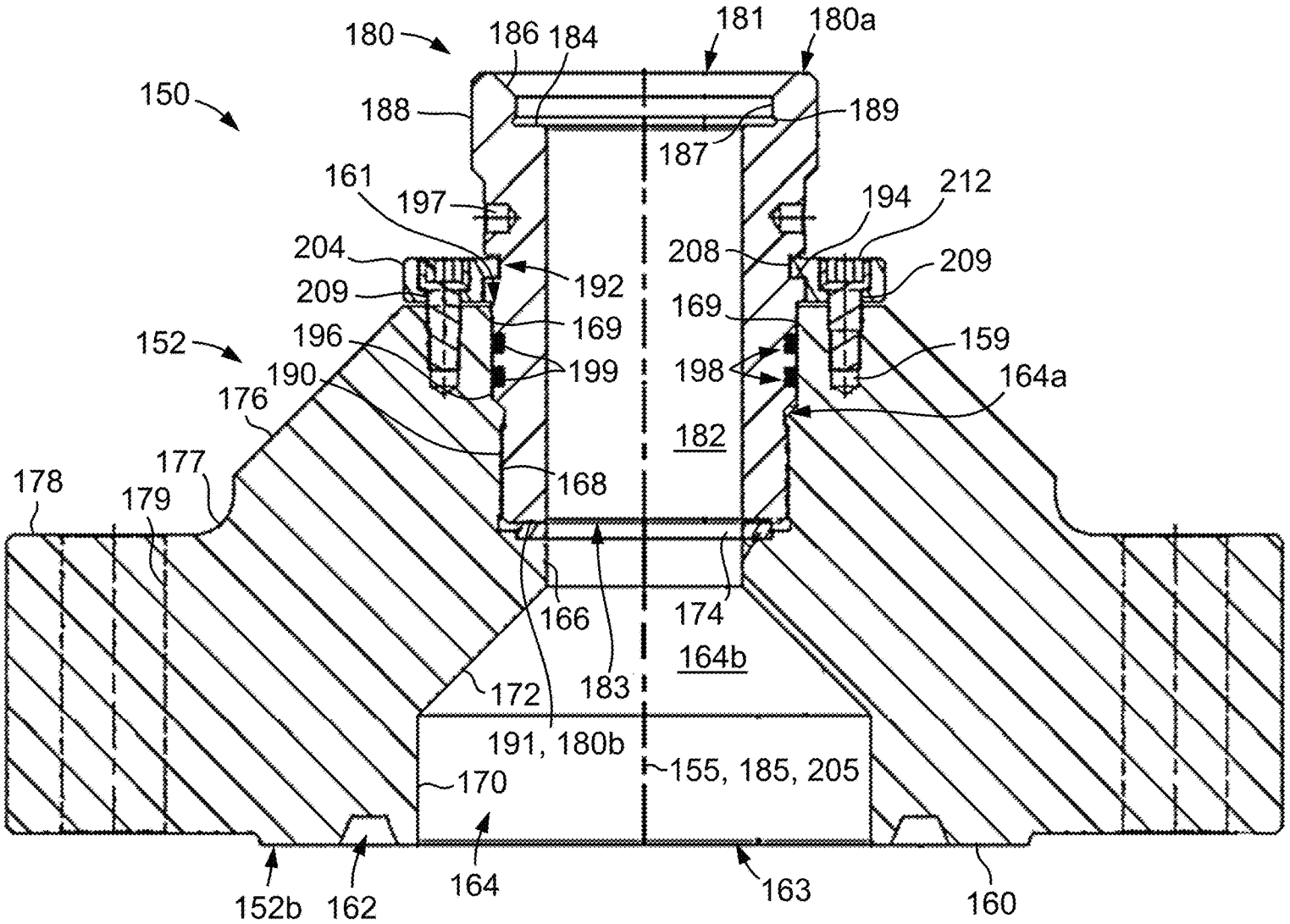
FIG. 10 is a side, cross-sectional view of the fluid coupling assembly of FIG. 5 according to some embodiments of the disclosure.

FIG. 9 shows the coupling adapter 180 of the fluid coupling 150 according to some embodiments. As is illustrated in FIG. 9, coupling adapter 180 may be an elongate tubular member that includes a central axis 185, a first end 180*a*, and a second end 180*b* opposite the first end 180*a*. As shown in FIG. 10, the second end 180*b* is inserted within the through-passage 164 of base 152 and the first end 180*a* is extended outward from through-passage 164 when coupling adapter 180 is connected to base 152. Thus, first end 180*a* may be referred to herein as the outer end 180*a* and the second end 180*b* may be referred to as the inner end 180*b* of the coupling adapter 180. As shown in FIG. 9, coupling adapter 180 also includes a throughbore 182 and a radially outer surface 180*c*, each extending between ends 180*a*, 180*b*.

Throughbore 182 extends axially through the coupling adapter 180 along central axis 185 from the outer end 180*a* to the inner end 180*b*. Thus, the throughbore 182 has a first or outer opening 181 positioned at the outer end 180*a* and a second or inner opening 183 positioned at the inner end 180*b*. An internal shoulder 184 is defined within the throughbore 182. In some embodiments, the internal shoulder 184 may be positioned axially closer (and more proximate) to the outer end 180*a* and outer opening 181 than the inner end 180*b* and inner opening 183. The internal shoulder 184 extends radially inward toward the central axis 185 within throughbore 182.

In addition, throughbore 182 may include a tapered or frustoconical surface 186 (or "chamfer") that extends from outer end 180*a* and outer opening 181 and a cylindrical surface 187 extending axially from frustoconical surface 186 to shoulder 184. The frustoconical surface 186 tapers radially inward toward central axis 185 when moving axially from outer end 180*a* and outer opening 181 toward cylindrical surface 187. Thus, the inner diameter of throughbore 182 may decrease when moving axially from outer end 180*a* and outer opening 181 toward cylindrical surface 187.

A circumferential or annular groove 189 is positioned along cylindrical surface 187. The annular groove 189 extends both radially into cylindrical surface 187 (and thus radially away from central axis 185) and circumferentially about the central axis 185. In some embodiments (such as the embodiment shown in FIG. 9), the annular groove 189 is positioned on the cylindrical surface 187 at the intersection with internal shoulder 184; however, in some embodiments the annular groove 189 may be axially spaced from the internal shoulder 184 along cylindrical surface 187.

Figure 11:
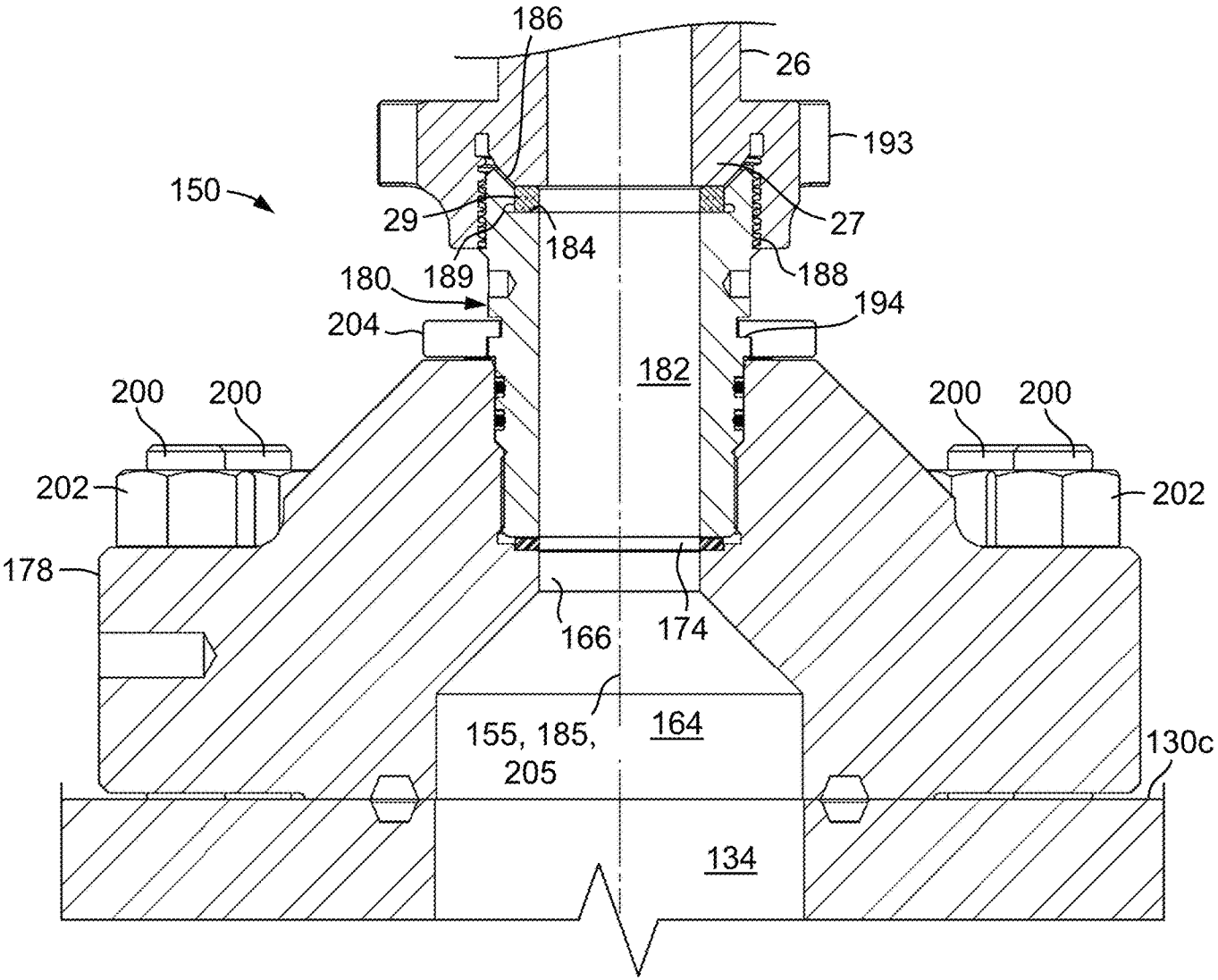
FIG. 11 is a side, cross-sectional view of the fluid coupling assembly of FIG. 5 engaged with a coupling connected to an output conduit of the hydraulic fracturing system of FIG. 1 according to some embodiments of the disclosure.

As shown in FIG. 11, during operations, a coupling 27 connected to a corresponding one of the outlet conduits 26 shown in FIG. 1 may be inserted into the throughbore 182 from outer opening 181. During this process, the frustoconical surface 186 may guide and center the coupling 27 within the throughbore 182, and the coupling 27 may be compressed into the shoulder 184. An annular seal ring 29 is positioned between the end face of the coupling 27 and the shoulder 184 such that the seal ring 29 is axially compressed between the coupling 27 and the shoulder 184 to thereby prevent or at least restrict leakage of fracturing fluid out of the throughbore 182. In some embodiments, the axial compression of the seal ring 29 (along the axis 155) may radially expand the seal ring 29 into the annular groove 189.

As shown in FIG. 9, an inner end face 191 is defined and positioned on the inner end 180*b*. The inner end face 191 may be a planar surface that extends radially relative to central axis 185 and circumferentially about the inner opening 183 of throughbore 182.

Radially outer surface 180*c* includes a first connection device 188 and a second connection device 190. The first connection device 188 and second connection device 190 may be any suitable connection feature (such as threads, clamps, etc.). In some embodiments (such as the embodiment shown in FIG. 9), the first connection device 188 includes a first set of external threads 188 and the second connection device 190 includes a second set of external threads 190.

The first set of external threads 188 may be more simply referred to herein as "first threads" 188 and the second set of external threads 190 may be more simply referred to herein as "second threads" 190. The first threads 188 and the second threads 190 may be separate and axially spaced from one another along radially outer surface 180*c*. In addition, the first threads 188 may be positioned axially closer (and more proximate) to outer end 180*a* than inner end 180*b*, and second threads 190 may be positioned more proximate to inner end 180*b* than outer end 180*a*. For instance, in some embodiments, the first threads 188 are positioned at (and extend axially from) the outer end 180*a* and the second threads 190 are positioned at (and extend axially from) the inner end 180*b*. The first threads 188 and the second threads 190 may include one or more grooves that extend radially into radially outer surface 180*c* and helically about the central axis 185.

An annular groove or recess 192 is axially positioned between the first threads 188 and the second threads 190. The recess 192 extends radially into the radially outer surface 180*c* toward central axis 185 and defines a radially extending annular external shoulder 194 that faces axially toward the outer end 180*a*. The annular external shoulder 194 may be more simply referred to herein as an "external shoulder" 194.

A first or outer cylindrical surface 195 extends axially between first threads 188 and annular recess 192, and a second or inner cylindrical surface 196 extends axially between external shoulder 194 and second threads 190. A plurality of engagement bores 197 extend radially into the outer cylindrical surface 195. In some embodiments, the engagement bores 197 are evenly circumferentially spaced about central axis 185 along outer cylindrical surface 195. As will be described in more detail below, engagement bores 197 may engage with a suitable tool (such as a spanner wrench) to facilitate threaded engagement or disengagement of the coupling adapter 180 from the through-passage 164 of base 152 (FIGS. 7 and 8) during operations.

As shown in FIG. 9, one or more annular seal grooves or recesses 198 are positioned along the inner cylindrical surface 196. The recesses 198 may be axially spaced from one another along inner cylindrical surface 196 and may each be configured to receive an annular seal member 199 (which may include an elastomer seal member such as an O-ring) therein. In some embodiments, each annular seal member 199 may be axially compressed between a pair of seal rings 199*a* within the corresponding recess 198. As will be described in more detail below, when coupling adapter 180 is inserted within through-passage 164 of base 152 (FIG. 8), the annular seal members 199 positioned in recesses 198 may sealingly engage the through-passage 164 to prevent or at least restrict the leakage of fracturing fluid from through-passage 164 and coupling adapter 180 during operations.

As is illustrated by FIGS. 4, 5, and 10, as previously noted, the coupling adapter 180 may represent the component of the fluid coupling assembly 150 having the highest likelihood of failure during a hydraulic fracturing operations. Thus, the coupling adapter 180 may be selectively installed or uninstalled from the through-passage 164 of base 152 during operations, so that in the event of a failure of the coupling adapter 180 (such as at the first threads 188), the coupling adapter 180 may be readily and quickly removed and replaced without disturbing the connection between flange 178 and the corresponding flow cross junction 130. Specifically, disconnection and removal of the threaded nuts 202 from each of the connection members 200 (FIG. 4) is tedious and therefor time consuming. In addition, because the base 152 is a relatively bulky component, the removal and replacement of the base 152 along with the coupling adapter 180 may involve the use of heavy lifting equipment, such as a crane, and therefore is associated with an increased risk of injury or further equipment damage. Accordingly, by separately providing a coupling adapter 180 that is removably inserted within the through-passage 164 of base 152, personnel may perform the much simpler and safer operation of disconnecting, removing, and replacing the coupling adapter 180 without disconnecting or distributing the connection between flange 178 and flow cross junction 130.

Figure 12:
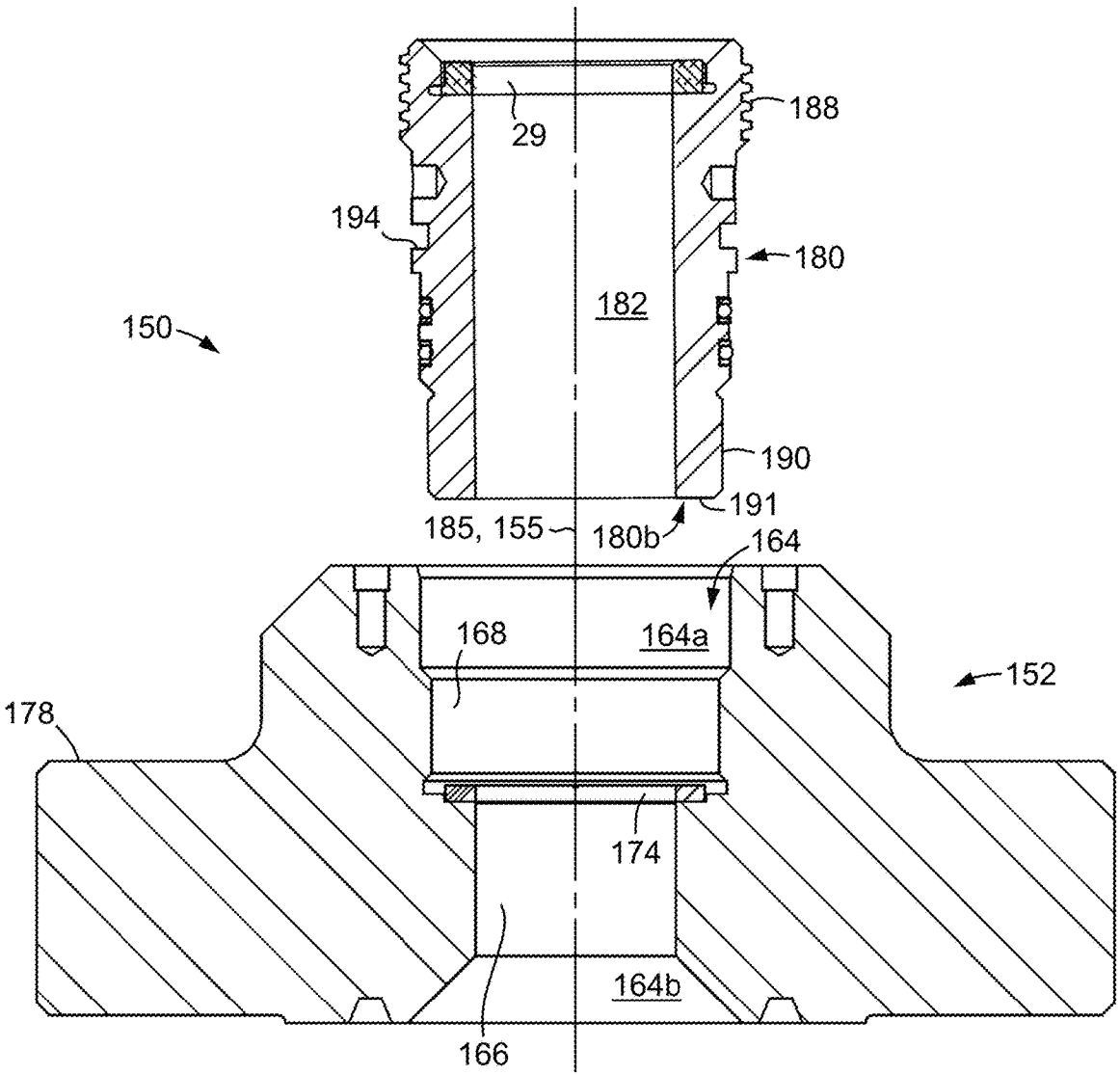
FIGS. 12-14 are sequential side, cross-sectional views of the coupling assembly of FIG. 5 showing the coupling adapter being inserted within a through passage of the base according to some embodiments of the disclosure.
Figure 13:
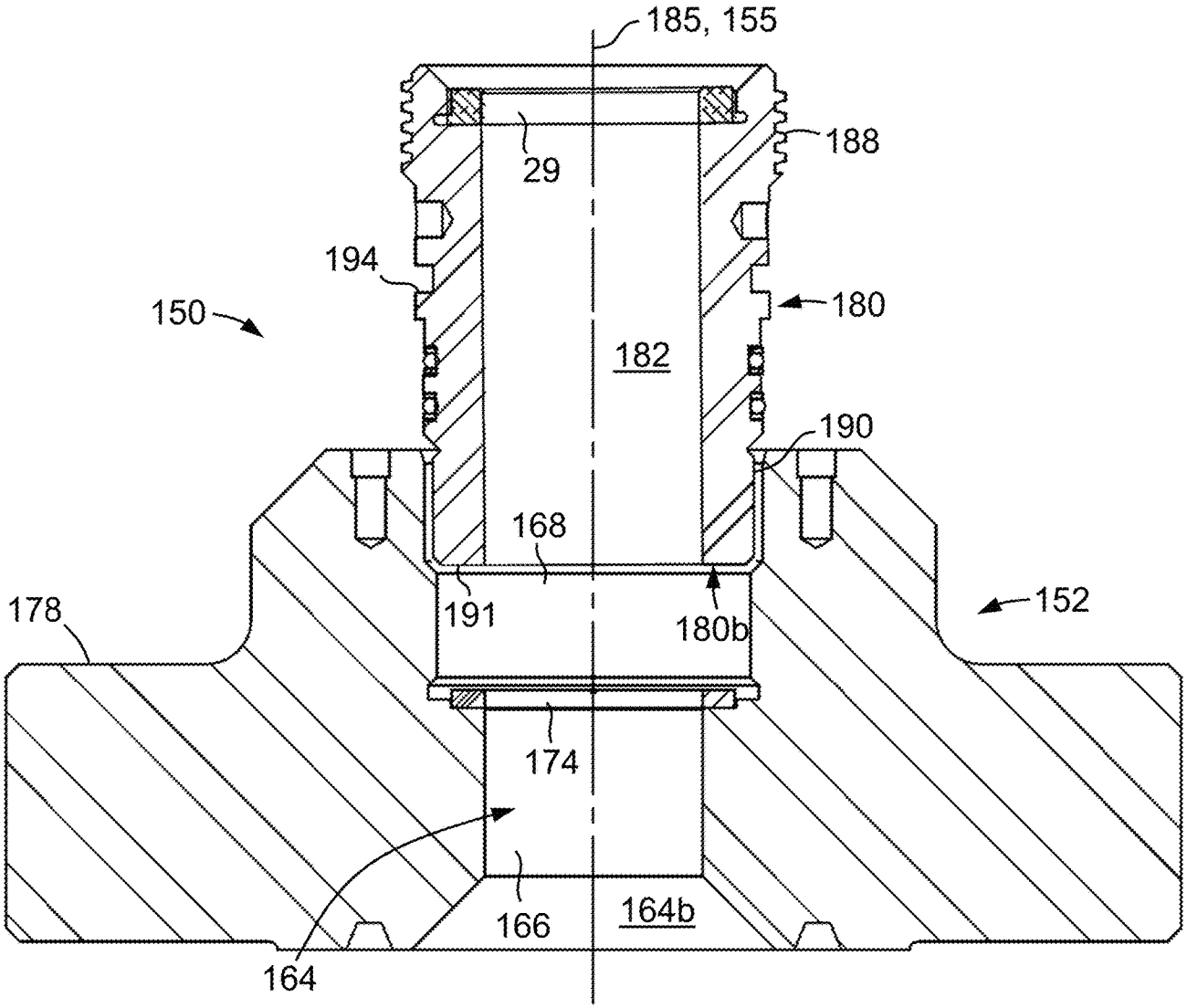
Figure 14:
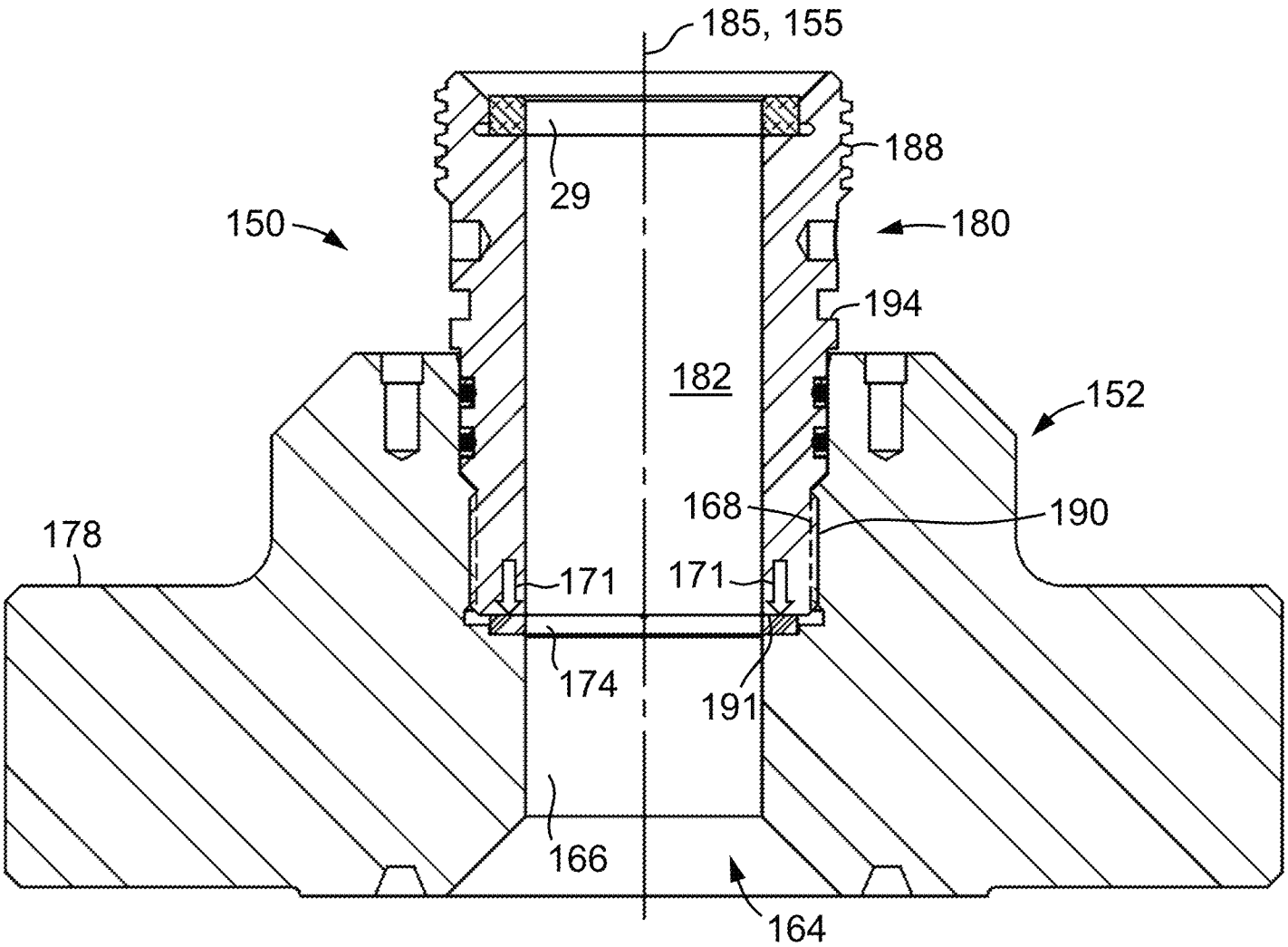

As shown in FIGS. 12-14, when installing the coupling adapter 180 into the through-passage 164 of base 152, the inner end 180*b* of coupling adapter 180 is inserted through outer opening 161 and into the outer portion 164*a* of through-passage 164 such that second threads 190 are threadably engaged with the interior threads 168. More particularly, as shown in the sequence from FIG. 12 to FIG. 13, the inner end 180*b* of coupling adapter 180 may be inserted into the outer portion 164*a* of through-passage 164 until second threads 190 are engaged or abutted with the interior threads 168. Thereafter, as shown in the sequence from FIG. 13 to FIG. 14, the coupling adapter 180 is rotated about axis 185 relative to base 152 so that second threads 190 threadably engage (or mesh) with interior threads 168 to force coupling adapter 180 axially into through-passage 164 from outer opening 161 (and thus outer end 152*a*) along the central axes 155, 185. Threaded engagement of threads 190, 168 continues until inner end face 191 on inner end 180*b* is engaged with and urged into gasket 174 such that gasket 174 is axially compressed between the inner end face 191 (and inner end 180*b*) and internal shoulder 166 of through-passage 164, and such that coupling adapter 180 is axially compressed against internal shoulder 166 via gasket 174 (along arrows 171 shown in FIG. 14). As previously described, the compression of gasket 174 between inner end face 191 and shoulder 166 (specifically seat 165) may create a fluid-tight seal that prevents or restricts fracturing fluid from leaking out of through-passage 164 or throughbore 182 radially between coupling adapter 180 and outer portion 164*a* of through-passage 164. During insertion of coupling adapter 180 within outer portion 164*a* of through-passage 164, a suitable tool such as a spanner wrench may be engaged with the engagement bores 197 on coupling adapter 180 to impart torque to the coupling adapter about the aligned axes 155, 185.

Figure 15:
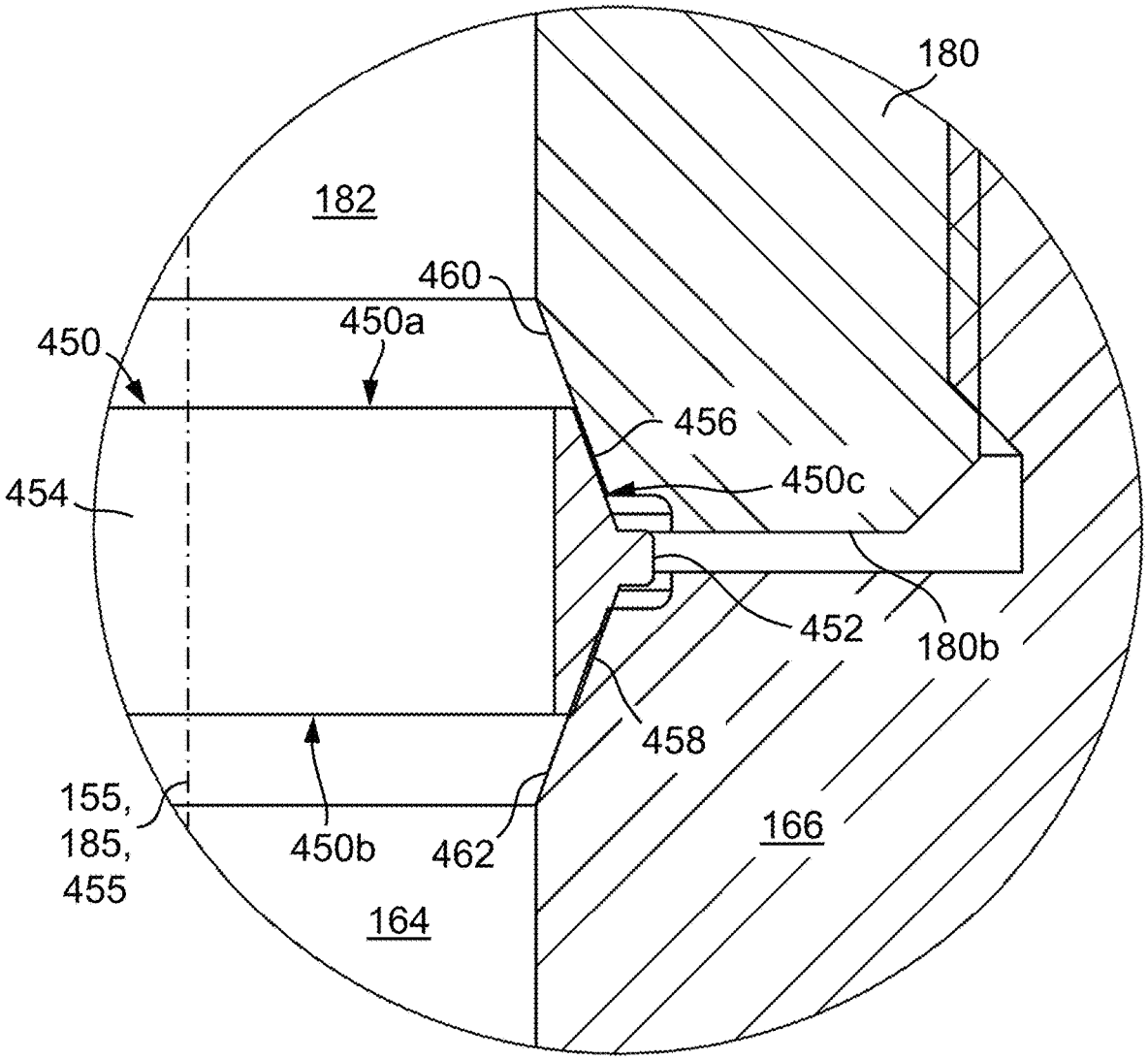
FIG. 15 is an enlarged cross-sectional view of a metallic seal junk ring that is engaged between the coupling adapter and the base of the fluid coupling assembly of FIG. 5 according to some embodiments of the disclosure.

As shown in FIG. 15, in some embodiments, the junk ring 174 may comprise a metallic gasket that is axially captured and compressed between the coupling adapter 180 (particularly inner end 180*b*) and shoulder 166. As shown in FIG. 15, the junk ring 174 when configured as a metallic gasket or seal may include a central axis 455, a first end 450*a*, a second end 450*b* opposite the first end 450*a*, a throughbore 454 extending between ends 450*a*, 450*b*, and a radially outer surface 450*c* also extending between ends 450*a*, 450*b*. The radially outer surface 450*c* may include a radially extending, annular projection 452 that is positioned axially between ends 450*a*, 450*b* along axis 455. In addition, radially outer surface 450*c* may include a first frustoconical surface 456 extending from the first end 450*a* to the projection 452 and a second frustoconical surface 458 extending from the projection to the second end 450*b*. The first frustoconical surface 456 may diverge radially away from the axis 455 when moving axially from the first end 450*a* toward the projection 452, and the second frustoconical surface 458 may diverge radially away from the axis 455 when moving axially from the second end 450*b* to the projection 452. When the metallic junk ring 174 is installed within the through-passage 164 and compressed between the shoulder 166 and inner end 180*b* of coupling adapter 180, the central axis 455 of junk ring 450 may be generally aligned with the axes 155, 185.

When the metallic seal junk ring 174 is compressed between the coupling adapter 180 and the shoulder 166 within the upper portion 164*a* of through-passage 164, the first frustoconical surface 456 may be engaged with a corresponding and complimentary frustoconical surface (or chamfer) 460 formed within the throughbore 182 of coupling adapter 180, and the second frustoconical surface 458 may be engaged with a corresponding and complimentary frustoconical surface (or chamfer) 462 formed on the shoulder 166 within the through-passage 164 of base 152. Thus, as may be appreciated in FIG. 15, as the coupling adapter 180 is threadably advanced into the through-passage 164, the engagement between the frustoconical surfaces 456, 458, 460, 462 may impart a radially inward pressure onto the junk ring 174, and the projection 452 may be axially compressed between the coupling adapter 180 and shoulder 166 (or between seats formed thereon). The radially inward pressure imparted to the junk ring 174 via the engagement of frustoconical surface 456, 458, 460, 462 may be directed normally through the engaged surfaces 452, 460 and normally through the engaged surfaces 454, 462. Thus, the engagement between the frustoconical surfaces 456, 458, 460, 462 and potentially the engagement between coupling adapter 180, shoulder 166 and projection 452 may form a fluid-tight seal between the seal ring 174 that prevents (or at least restricts) the leakage of fracturing fluid out of the through-passage 164 and along the outer surface 180*c* of coupling adapter 180.

Thus, by threadably engaging the coupling adapter 180 within the through-passage 164 of base 152, the coupling adapter 180 is axially (and potentially radially) compressed into the through-passage 164 and against the internal shoulder 166 along the aligned axes 155, 185 (such as along arrows 171 in FIG. 14). Without being limited to this or any other theory, compressing the coupling adapter 180 axially into the through-passage 164 may counter a pressure of the fracturing fluid that may tend to push the coupling adapter 180 out of the through-passage 164 during operations.

As may be appreciated from FIGS. 10 and 14, the insertion of the coupling adapter 180 within the through-passage 164 of base 152 may position the outer end 180*a*, the first threads 188, the engagement bores 197, and the annular recess 192 and external shoulder 194 outside of the through-passage 164 at the outer end 152*a* of base 152. Thus, the first threads 188 and outer end 180*a* of coupling adapter 180 are accessible to allow connection to an output of one of the outlet conduits 26 (FIG. 1) as previously described. As shown in FIG. 11, the coupling 27 connected to one of the output conduits 26 may include a connector 193 (such as a threaded connector, a hammer union, a flanged connector, a clamp, a hub, a swivel, a weld component, etc.) that is engageable with the coupling adapter 180 to thereby connect the coupling adapter 180 to the outlet conduit 26. For instance, in the embodiment shown in FIG. 11, the connector 193 is a threaded hammer union that is threadably engaged with the first threads 188 to axially compress the coupling 27 into the shoulder 184 within the throughbore 182 of coupling adapter 180 as previously described.

In addition, as is shown in FIG. 10, when coupling adapter 180 is inserted and engaged within outer portion 164*a* of through-passage 164, the inner cylindrical surface 196 of coupling adapter 180 is engaged with cylindrical surface 169 within outer portion 164*a*. As a result, the annular sealing members 199 positioned within recesses 198 of coupling adapter 180 may be sealingly engaged between the recesses 198 and cylindrical surface 169 to provide and additional seal to prevent or restrict fracturing fluid from leaking radially between the coupling adapter 180 and the outer portion 164*a* of through-passage 164 of base 152.

Figure 16:
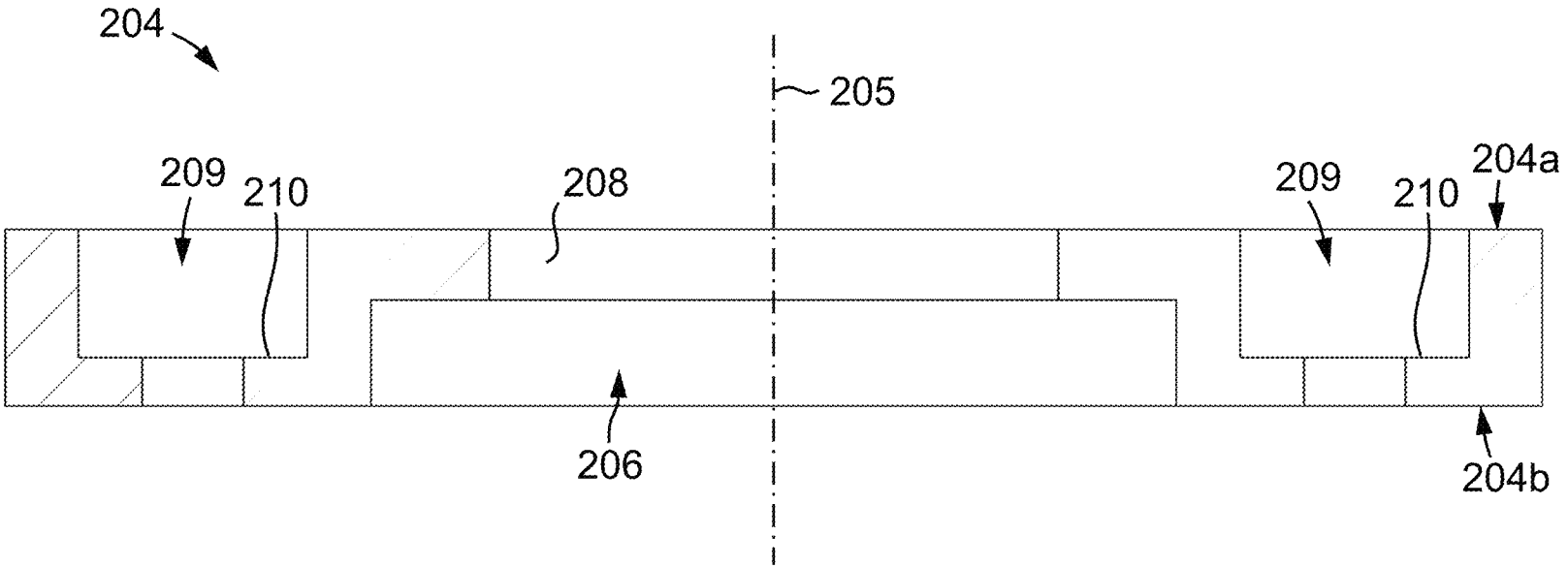
FIG. 16 is a side, cross-sectional view of a retainer ring of the fluid coupling assembly of FIG. 5 according to some embodiments of the disclosure.

As shown in FIGS. 5 and 10, after coupling adapter 180 is inserted and engaged within outer portion 164*a* of through-passage 164 of base 152 as described above, a retainer ring 204 may be engaged with external shoulder 194 on radially outer surface 180*c* of coupling adapter 180 to prevent (or restrict) rotation of the coupling adapter 180 within through-passage 164 about axes 155, 185. Specifically, FIG. 16 illustrates the retainer ring 204 according to some embodiments. The retainer ring 204 may include a first side 204*a*, a second side 204*b* opposite first side 204*a*, and central opening 206 extending along a central axis 205 between the first side 204*a* and the second side 204*b*. In addition, a projection 208 extends circumferentially about the central opening 206 about central axis 205, and a plurality of mounting apertures 209 extend axially between sides 204*a*, 204*b* that are circumferentially spaced about axis 205. In some embodiments, the mounting apertures 209 are uniformly circumferentially spaced about axis 205. Each mounting aperture 209 shown in FIG. 9 includes a shoulder 210 (such as an annular shoulder).

Figure 17:
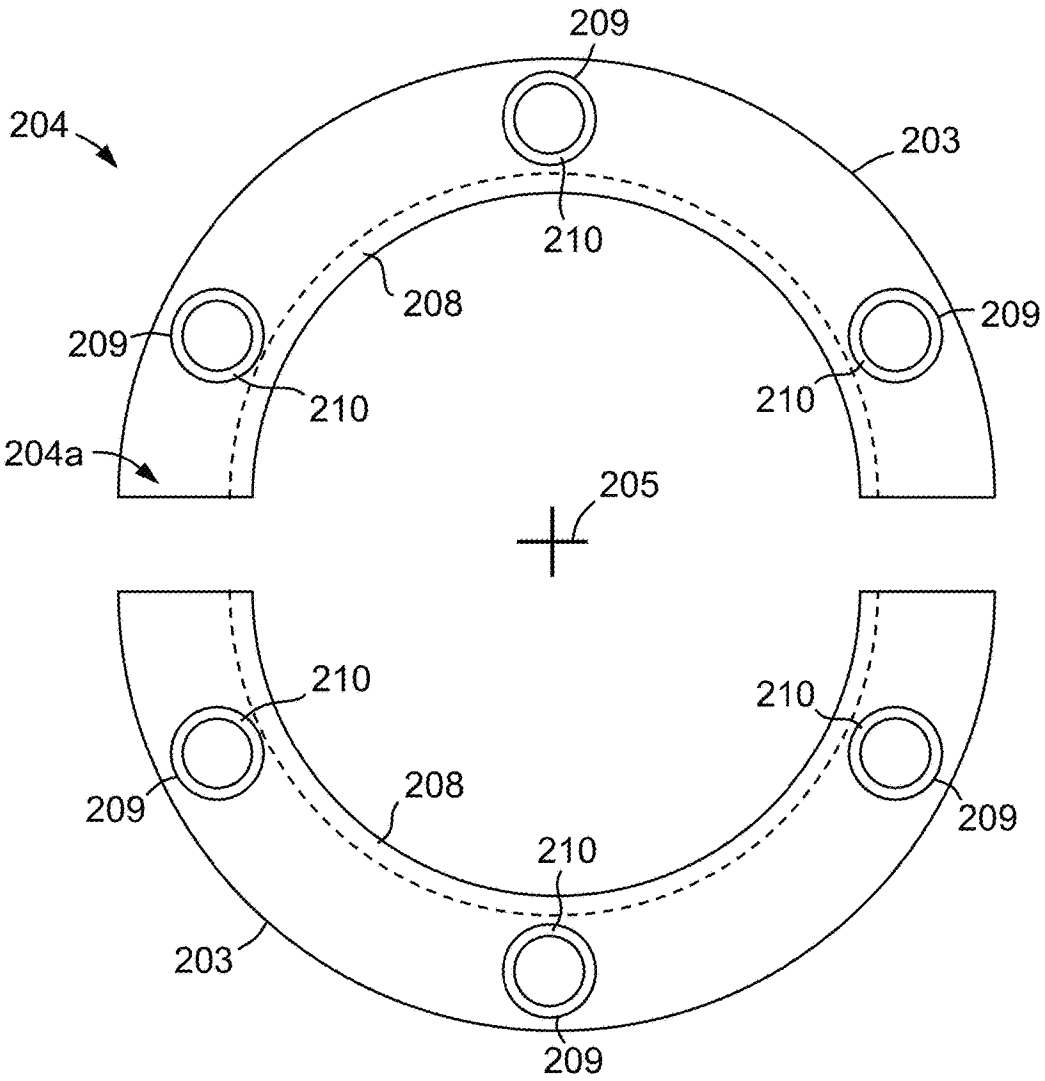
FIG. 17 is a top view of the retainer ring of the coupling assembly of FIG. 5 according to some embodiments of the disclosure.
Figure 18:
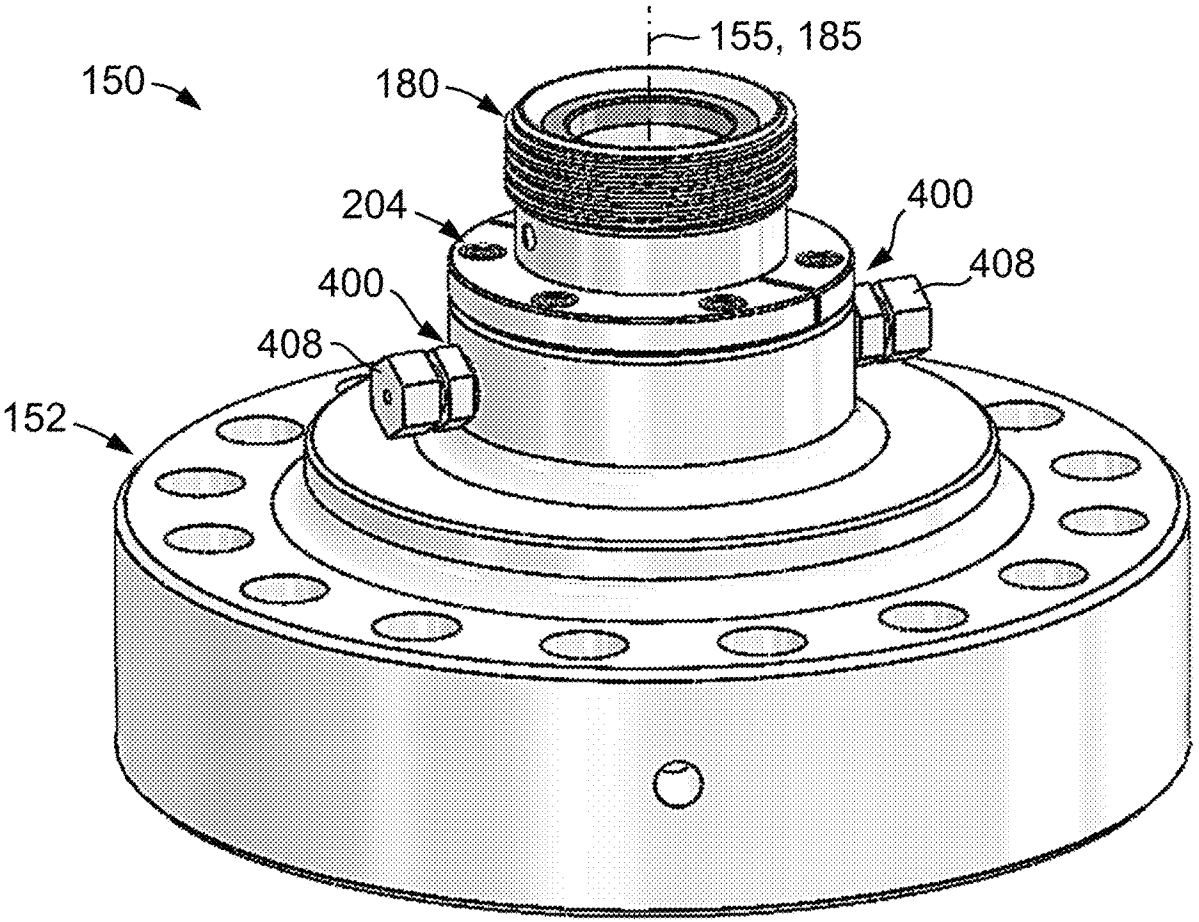
FIG. 18 is a perspective view of a fluid coupling assembly having a removable coupling adapter and including fluid ports according to some embodiments of the disclosure.
Figure 19:
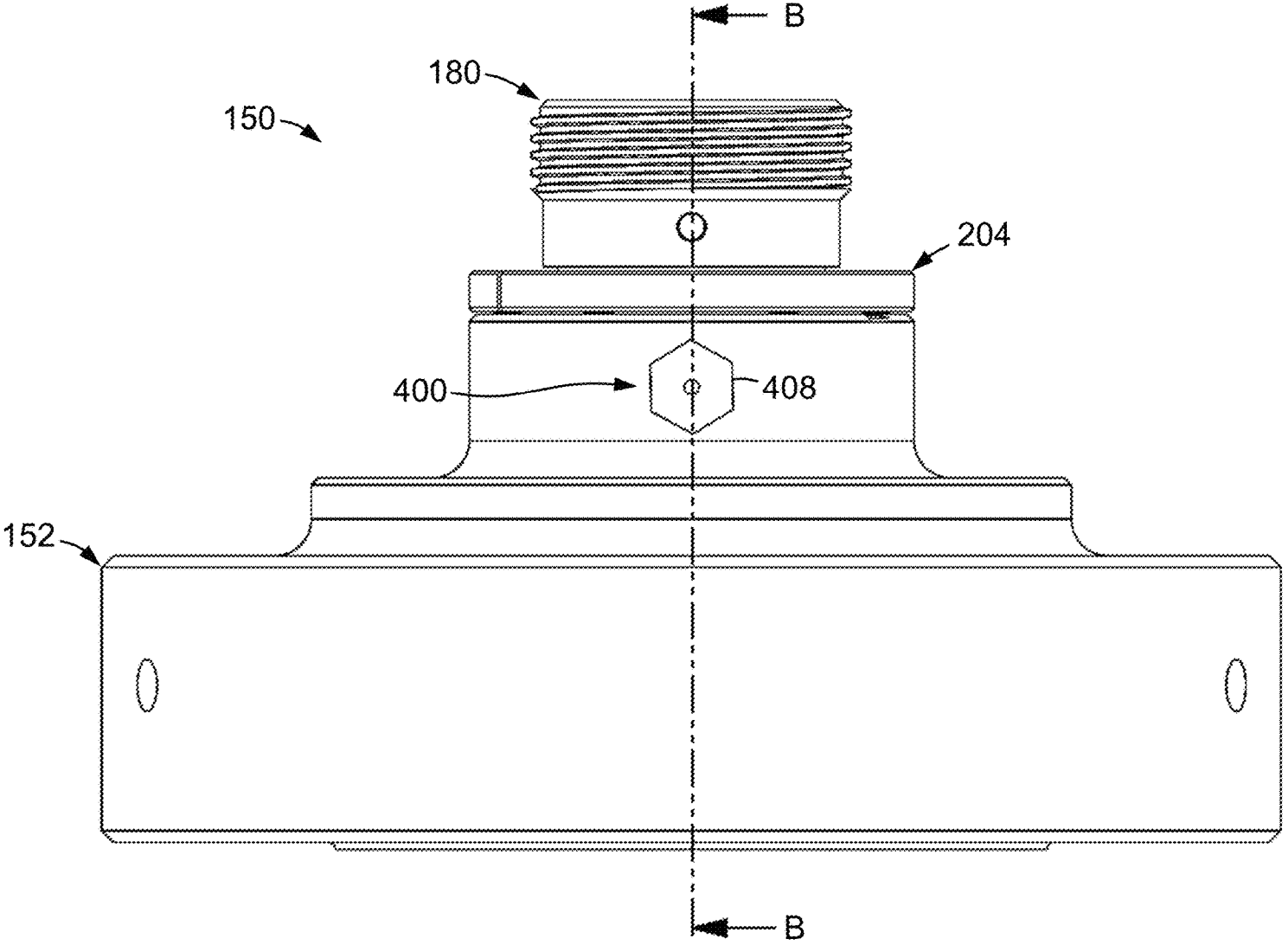
FIG. 19 is a side view of the fluid coupling assembly of FIG. 18 according to some embodiments of the disclosure.

As shown in FIG. 17, retainer ring 204 may be formed of a plurality of ring segments 203 that may be joined together. In some embodiments, the retainer ring 204 includes two ring segments 203, each extending about 180° about the axis 205 when ring segments 203 are joined together to form the retainer ring 204. However, other numbers and arrangements of ring segments 203 are contemplated. For instance, in some embodiments, retainer ring 204 is formed of more than two ring segments 203. In addition, in some embodiments, the ring segments 203 (whether there are two or more than two) may have different arc lengths about axis 205.

As shown in FIGS. 5, 6, and 10, during operations, the ring segments 203 of retainer ring 204 are joined together about the coupling adapter 180 such that the projection 208 is inserted within the recess 192 on radially outer surface 180*c* of coupling adapter 180. A plurality of mounting members 212 (such as threaded screws) may be inserted through the mounting apertures 209 and threadably engaged within the mounting bores 159 formed on outer end face 158 of base 152. The mounting members 212 may engage with the shoulders 210 formed in mounting apertures 209 so that projection 208 is compressed axially into the external shoulder 194 on coupling adapter 180. When retainer ring 204 is connected to base 152 so that projection 208 is compressed against external shoulder 194 of coupling adapter 180, the central axis 205 of retainer ring 204 may be aligned with the central axis 185 of coupling adapter 180 and/or the central axis 155 of base 152.

Without being limited to this or any other theory, engaging the retainer ring 204 with the external shoulder 194 of coupling adapter 180 may further secure the coupling adapter 180 within the through-passage 164 against the pressure of the fracturing fluid within the outlet manifold 100 during operations as previously described above. In addition, engaging the retainer ring 204 with the external shoulder 194 of coupling adapter 180 may also relieve pressure on the engaged threads 168, 190 during operations. Further, preventing (or restricting) rotation of the coupling adapter 180 about the central axis 185 via the retainer ring 160 may prevent unthreading of the coupling adapter 180 from the outer portion 164*a* of through-passage 164 (such as via second threads 190 and interior threads 168) during operations (such as when installing or removing the connector 193 from the coupling adapter 180 via first threads 188).

The removal of coupling adapter 180 from through-passage 164 of base 152 may be accomplished by reversing the sequence described above for installing the coupling adapter 180 into through-passage 164. For instance, the retainer ring 204 may be removed from the base 152 via removal of mounting members 212 from mounting bores 159 (FIGS. 5, 6, and 10). Thereafter, the coupling adapter 180 may be unthreaded from through-passage 164 by rotating coupling adapter 180 about central axis 185 within through-passage 164 (such as via a spanner wrench or other suitable tool) to threadably disengage the threads 190, 168 (see the sequence from FIG. 14 to FIG. 13). Once second threads 190 on coupling adapter 180 are fully disengaged with internal threads 168, the coupling adapter 180 may be removed from through-passage 164 (and repaired or replaced as appropriate) at the first end 152*a* of base 152 (see the sequence from FIG. 13 to FIG. 12). It should be noted that during the removal of coupling adapter 180 from through-passage 164, the connection between flange 178 and the corresponding flow cross junction 130 (such as between the connection members 200 and threaded nuts 202 shown in FIG. 4) may be undisturbed as previously described.

Figure 20:
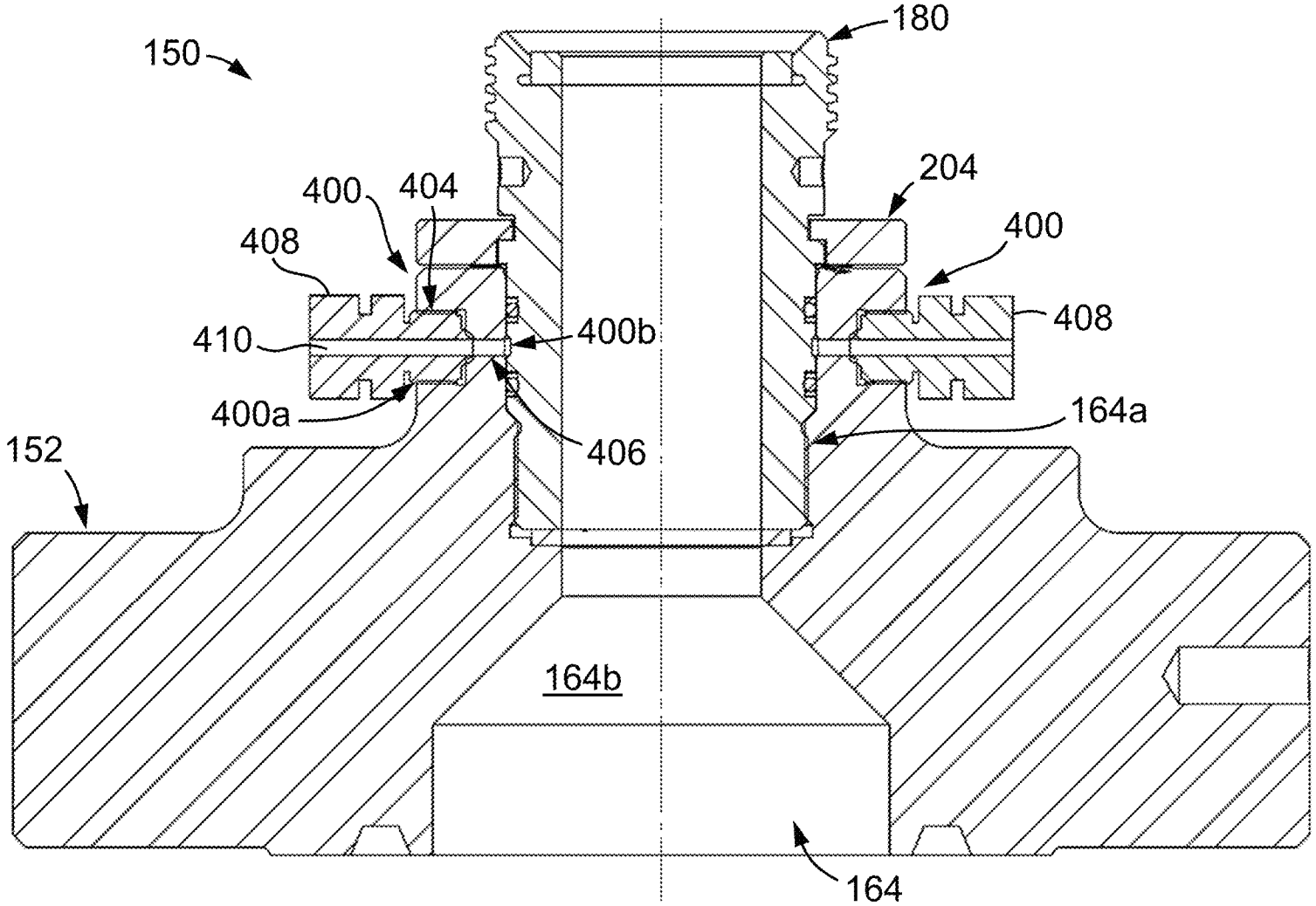
FIG. 20 is a cross-sectional view of the fluid coupling assembly of FIG. 18 taken along section B-B in FIG. 19 according to some embodiments of the disclosure.
Figure 21:
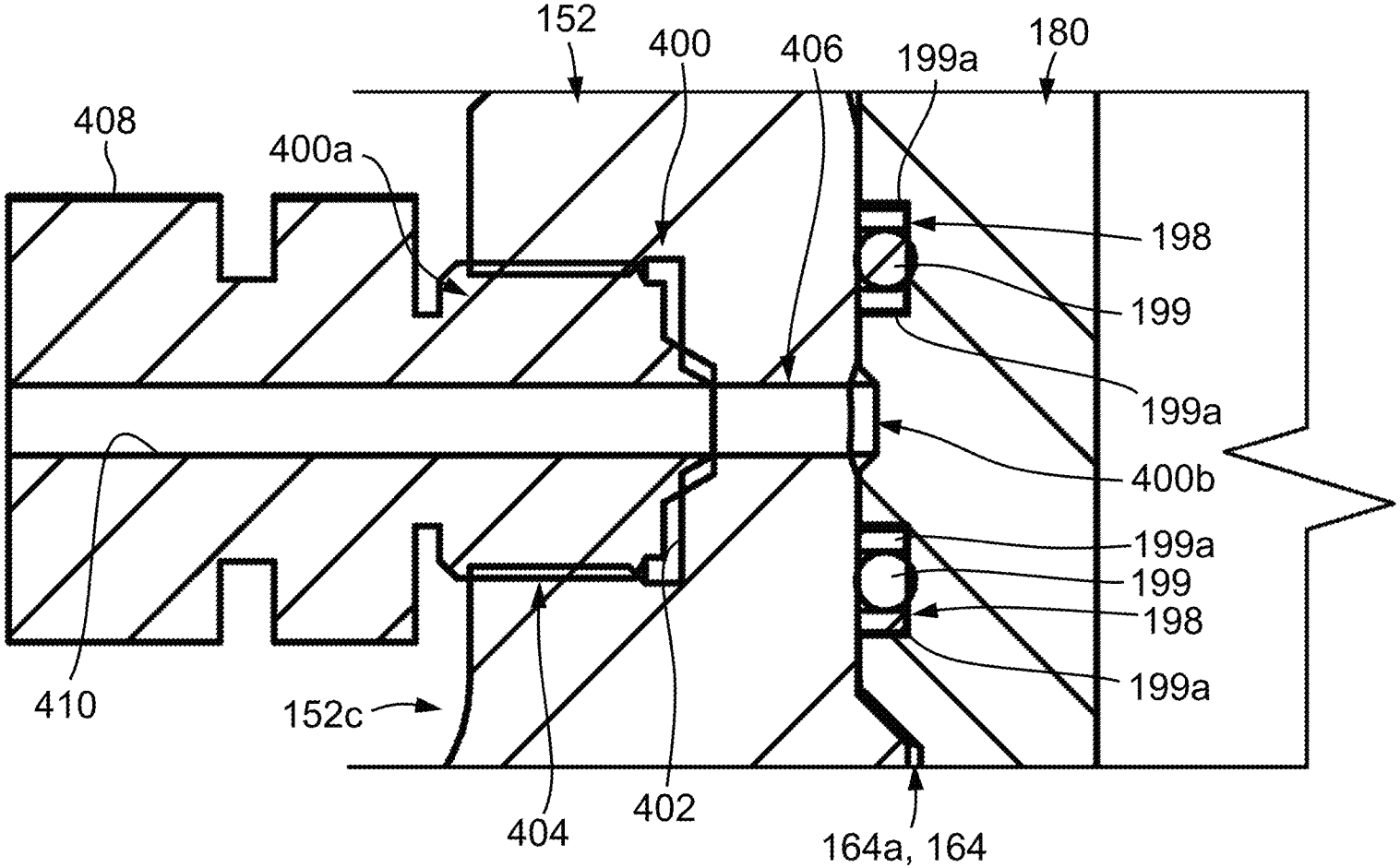
FIG. 21 is an enlarged cross-sectional view of one of the fluid ports of the fluid coupling assembly of FIG. 18 according to some embodiments of the disclosure.

In some embodiments, the fluid coupling 150 may include one or more fluid ports for pressure and/or fluid communication. For instance, as shown in FIGS. 18-21, in some embodiments, the base 152 may include one or more fluid injection ports 400 that allow fluid communication with the through passage 164. Specifically, as best shown in FIGS. 20 and 21, each fluid injection port 400 may extend from a first or outer end 400*a* positioned along a radially outer surface 152*c* and a second or inner end 400*b* positioned within the outer portion 164*a* of the through passage 164. An annular shoulder 402 may be positioned within the port 400, between the ends 400*a*, 400*b* that separates or divides the port 400 into a first or outer portion 404 that extends from the outer end 400*a* to the annular shoulder 402 and a second or inner portion 406 that extends from the annular shoulder 402 to the inner end 400*b*. The outer portion 404 may be threaded and may have a larger inner diameter than the inner portion 406.

A tap 408 may be threadably engaged within the outer portion 404. The tap 408 may include a throughbore 410 that is aligned with the inner portion 406 of port 400 when tap 408 is threadably engaged within outer portion 404 (such as shown in FIGS. 20 and 21). During operations, the tap 408 may be connected to a source of injection fluid that may be flowed through the throughbore 410, and the inner portion 406 to thereby flow into the upper portion 164*a* of through passage 164. In particular, in the illustrated embodiments, the inner end 400*b* may be positioned axially between the annular seal members 199 (along the axes 155, 185) so that during operations an injectable sealant or packing (such as, polytetrafluoroethylene (PTFE), graphite, grease, polymer-based sealant, etc.) may be injected into the outer portion 164*a* of through-passage 164, axially between the annular sealing members 199 along the axes 185, 155 so as to form an additional seal between the coupling adapter 180 and through-passage 164 during operations. For instance, the injectable sealant may be injected into the upper portion 164*a* of through passage 164 when one or both of the annular seal members 199 has failed so as to prevent leakage of fracturing fluid from the fluid coupling assembly 150. Thus, by injecting the injectable sealant into the through-passage 164 (particularly, upper portion 164*a* and axially between the annular seal members 199 along axes 155, 185), personnel may minimize stoppage time for the hydraulic fracturing system 10 by avoiding the removal of the coupling assembly 180 from base 152 to replace a failed one or more of the annular sealing members 199. Injectable sealant may also be injected into through passage 164 one or more of the ports 400 as a prophylactic measure to avoid the leakage of fracturing fluid during operations.

While not specifically shown, it should be appreciated that during operations, a plug (not shown) may be installed within the ports 400 (particularly outer portion 404) to prevent leakage of fluid and/or sealant out of the port 400 from the through-passage 164. In some embodiments, the plug (not shown) may be generally the same as the tap 408 but may lack the throughbore 410.

In addition, in some embodiments, one or more of the ports 400 may be used to test a condition or sealing performance of one or both of the annular seal members 199. For instance, a source of pressure may be connected to the one or more of the ports 400 (such as via the tap 408 or another suitable connector) so that pressurized fluid (such as air, water, oil, hydraulic fluid, etc.) may be forced into the through passage 164 via the port 400. The pressure of the injected fluid may be monitored (such as via a pressure gauge, sensor, or other suitable mechanism or device). If the pressure of the injected fluid is relatively stable or constant, this would provide an indication that both of the annular seal members 199 are holding pressure and therefore are performing acceptably. However, if the pressure of the injected fluid drops (or cannot be maintained above a threshold), the determination may be made that at least one of the annular seal members 199 has failed. Additional information may be utilized to determine which of the two annular seal members 199 has likely filed (such as, the pressure within the rest of the through passage 164 or manifold 100 more broadly, the leakage of the pressurized fluid out of the outer opening 161 at first end 152*a* of base 152, etc.). If the determination is made that one or both of the annular seal members 199 has failed, then the ports 400 may be utilized to inject an injectable sealant as previously described.

Figure 22:
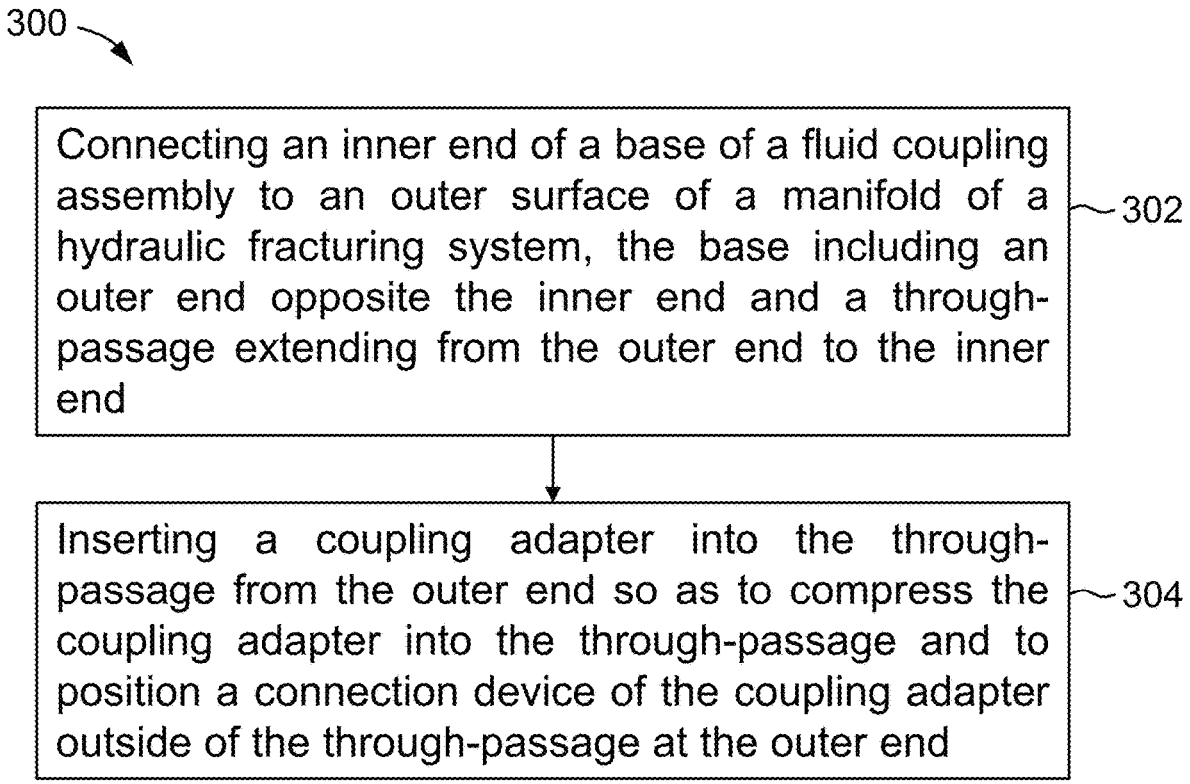
FIGS. 22 and 23 are diagrams of methods of installing a coupling adapter within a coupling assembly for an outlet manifold of a hydraulic fracturing system according to some embodiments of the disclosure.

A method 300 of installing a coupling adapter within a fluid coupling assembly for an outlet manifold of a hydraulic fracturing system is shown according to some embodiments in FIG. 22. In some embodiments, the method 300 may be performed to install a coupling adapter 180 within the base 152 of the coupling assembly 150 previously described above and shown in FIGS. 5-21. Thus, in describing the method 300, continuing reference will be made to FIGS. 5-21. However, it should be appreciated that method 300 may be performed using a fluid coupling assembly that is different in some respect(s) from the fluid coupling assembly 150. Therefore, reference to the fluid coupling assembly 150 shown in FIGS. 5-21 should not be interpreted as limiting other potential embodiments of method 300.

Initially, method 300 includes connecting an inner end of a base of a fluid coupling assembly to an outer surface of a manifold of a hydraulic fracturing system at block 302. The base may include an outer end opposite the inner end and a through-passage extending from the outer end to the inner end. For instance, as illustrated by FIGS. 8 and 10 and described above, the base 152 includes inner end 152*a*, outer end 152*b*, and a through passage 164 extending between ends 152*a*, 152*b*. The inner end 152*a* is connected to an outer surface of the outlet manifold 100, and particularly to the outer surface 130*c* of one of the flow cross junctions 130 of outlet manifold 100.

As shown in FIG. 22, method 300 also includes inserting a coupling adapter into the through-passage from the outer end so as to compress the coupling adapter into the through-passage and to position a connection device of the coupling adapter outside of the through-passage at the outer end at block 304. For instance, as previously described and as may be appreciated from FIGS. 10 and 12-14, a coupling adapter 180 may be inserted and threaded into the through-passage 164 via engagement of the threads 168, 190 such that the coupling adapter 180 is compressed into the through-passage 164 and particularly such that the inner end 180*b* of the coupling adapter 180 is compressed against the internal shoulder 166 within through-passage 164. Once inserted into the through-passage 164, the connection device 188 of coupling adapter 180 is positioned outside the through-passage 164 at the outer end 152*a* of base 152.

Figure 23:
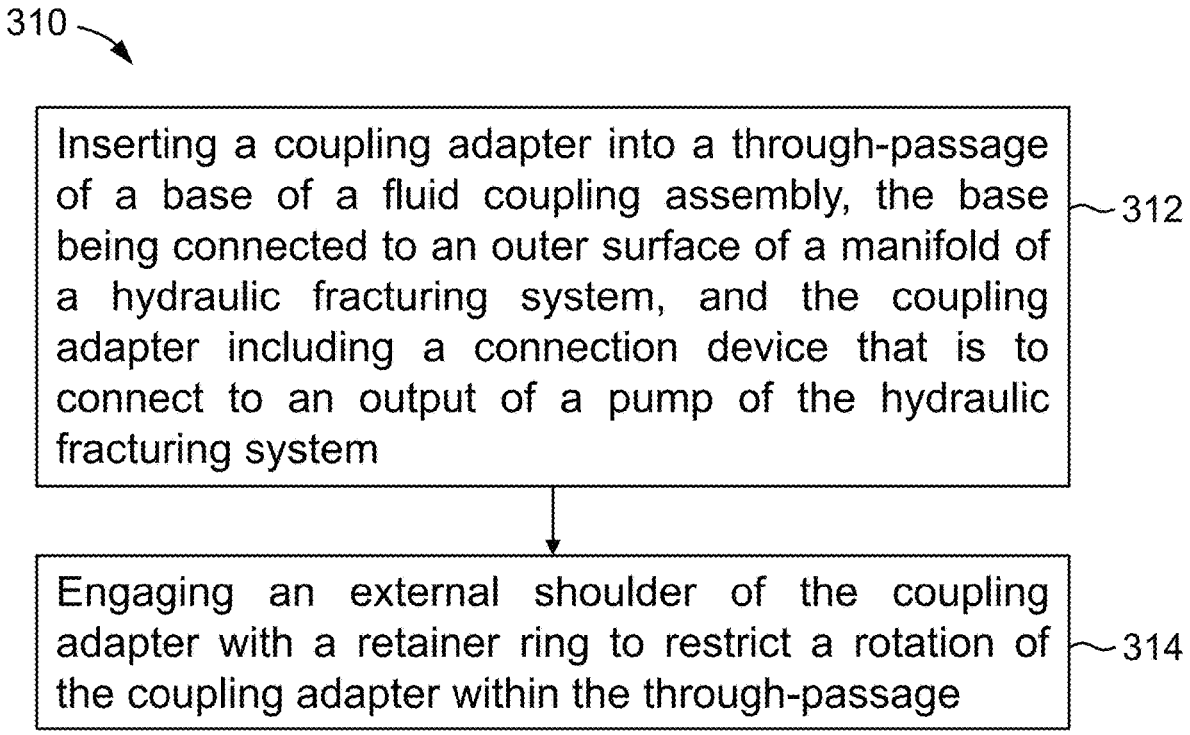

Another method 310 of installing a coupling adapter within a fluid coupling assembly for an outlet manifold of a hydraulic fracturing system is shown according to some embodiments is shown in FIG. 23. In some embodiments, the method 310 may be performed to install a coupling adapter 180 within the base 152 of the coupling assembly 150 previously described above and shown in FIGS. 5-21. Thus, in describing the method 310, continuing reference will be made to FIGS. 5-21. However, it should be appreciated that method 300 may be performed using a fluid coupling assembly that is different in some respect from the fluid coupling assembly 150. Therefore, reference to the fluid coupling assembly 150 shown in FIGS. 5-21 should not be interpreted as limiting other potential embodiments of method 300.

Initially, method 310 includes inserting a coupling adapter into a through-passage of a base of a fluid coupling assembly at block 312. The base is connected to an outer surface of a manifold of a hydraulic fracturing system, and the coupling adapter includes a connection device that is to connect to an output of a pump of the hydraulic fracturing system. For instance, as illustrated by FIGS. 8 and 10 and described above, the base 152 is connected at its inner end 152*b* to an outer surface of the outlet manifold 100, particularly to the outer surface 130*c* of one of the flow cross junctions 130 of outlet manifold 100. In addition, the coupling adapter 180 may be inserted into the through passage 164 so that the connection device 188 is positioned outside the through-passage 164.

As shown in FIG. 23, method 310 also includes engaging an external shoulder of the coupling adapter with a retainer ring to restrict a rotation of the coupling adapter within the through-passage at block 314. For instance, as previously described and as may be appreciated from FIG. 10, a coupling adapter 180 may be inserted into the through-passage 164 and the retainer ring 204 may be engaged with an external shoulder 194 on radially outer surface 180*c* of coupling adapter 180 to thereby prevent (or restrict) the rotation of the coupling adapter within the through-passage 164.

Figure 24:
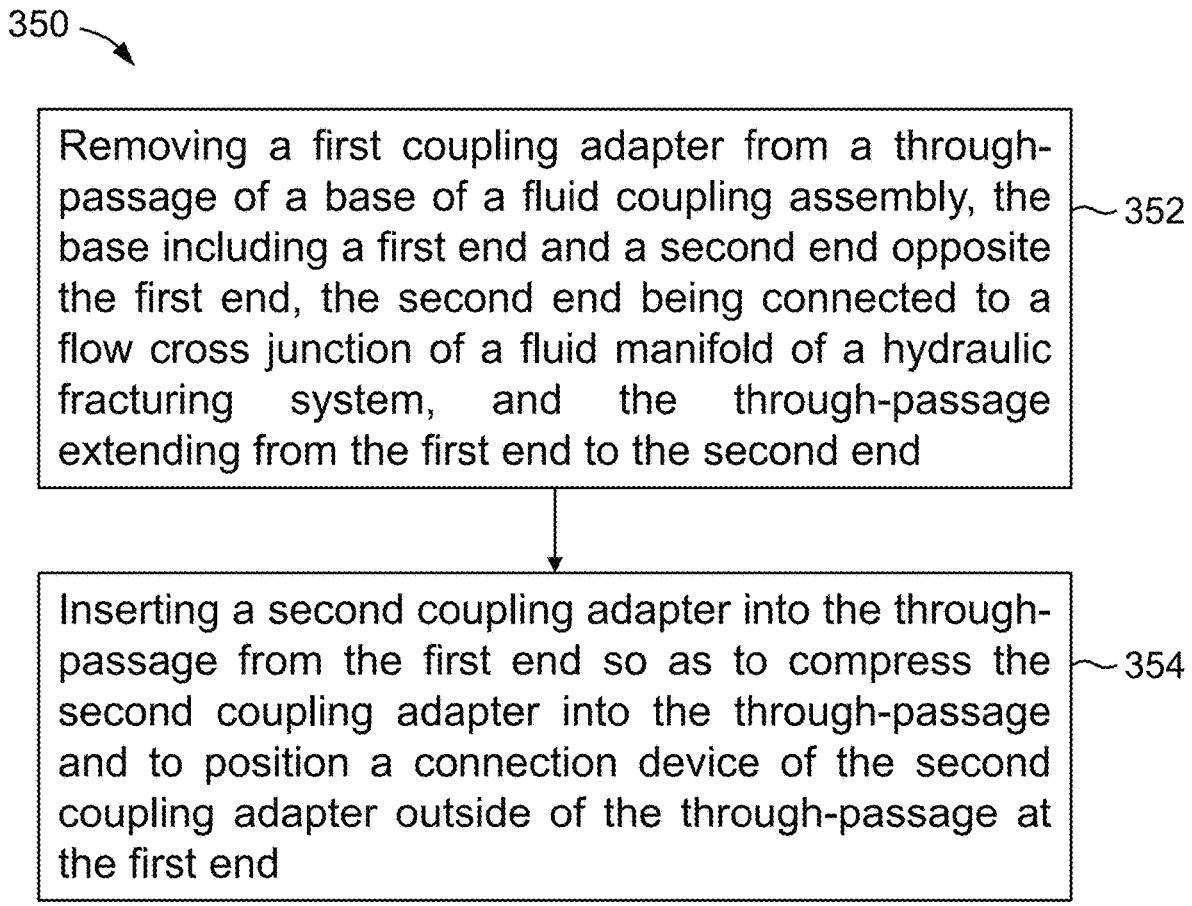
FIG. 24 is a diagram of a method of replacing a coupling adapter of a coupling assembly for an outlet manifold of a hydraulic fracturing system according to some embodiments of the disclosure.

A method 350 of replacing a coupling adapter of a coupling assembly for an outlet manifold of a hydraulic fracturing system is shown according to some embodiments is shown in FIG. 24. In some embodiments, the method 350 may be performed to replace a coupling adapter 180 within the base 152 of the coupling assembly 150 previously described above and shown in FIGS. 5-21. Thus, in describing the method 350, continuing reference will be made to FIGS. 5-21. However, it should be appreciated that method 350 may be performed using a fluid coupling assembly that is different in some respect from the fluid coupling assembly 150. Therefore, reference to the fluid coupling assembly 150 shown in FIGS. 5-21 should not be interpreted as limiting other potential embodiments of method 350.

Initially, method 350 includes removing a first coupling adapter from a through-passage of a base of a fluid coupling assembly at block 352. The base may include a first end and a second end opposite the first end. In addition, the second end may be connected to a flow cross junction of a fluid manifold of a hydraulic fracturing system. Further, the through-passage of the base may extend from the first end to the second end. For instance, as illustrated by FIGS. 12-14 and described above, the coupling adapter 180 of coupling assembly 150 may be removed from the through-passage 164 of base 152 by disengaging threads 168, 190. The base 152 includes a first end 152*a*, a second end 152*b*, and a through-passage 164 extending between ends 152*a*, 152*b*. The second end 152*b* may be connected to an outer surface of the outlet manifold 100 (FIG. 3), particularly to a radially outer surface 130*c* of one of the flow cross junctions 130 of outlet manifold 100 (FIG. 4).

As shown in FIG. 24, method 350 also includes inserting a second coupling adapter into the through-passage from the first end so as to compress the second coupling adapter into the through-passage and to position a connection device of the second coupling adapter outside the through-passage at the first end at block 354. For instance, as previously described and as may be appreciated from FIGS. 10 and 12-14, after the removal a coupling adapter 180 (such as a failed coupling adapter 180) from through-passage 164 of base 152, a new coupling adapter 180 may be inserted and threaded into the through-passage 164 via engagement of the threads 168, 190 so as to compress the new coupling adapter 180 into the through-passage 164 and to position the connection device 188 of the new coupling adapter 180 outside the through-passage 164.

In some embodiments, method 350 may include disengaging a retainer ring (such as the retainer ring 204) from an external shoulder (such as the shoulder 194) on the first coupling adapter and from the first end of the base before block 302 and/or engaging a retainer ring with an external shoulder on the second coupling adapter and to the first end of the base after block 308. In addition, in some embodiments, the method 300 may include axially compressing the coupling adapter against an internal shoulder (such as the internal shoulder 166) positioned within the through-passage as a result of block 308. In some embodiments, axially compressing the coupling adapter against the internal shoulder may include compressing a gasket (such as the gasket 174) between the coupling adapter and the internal shoulder.

Figure 25:
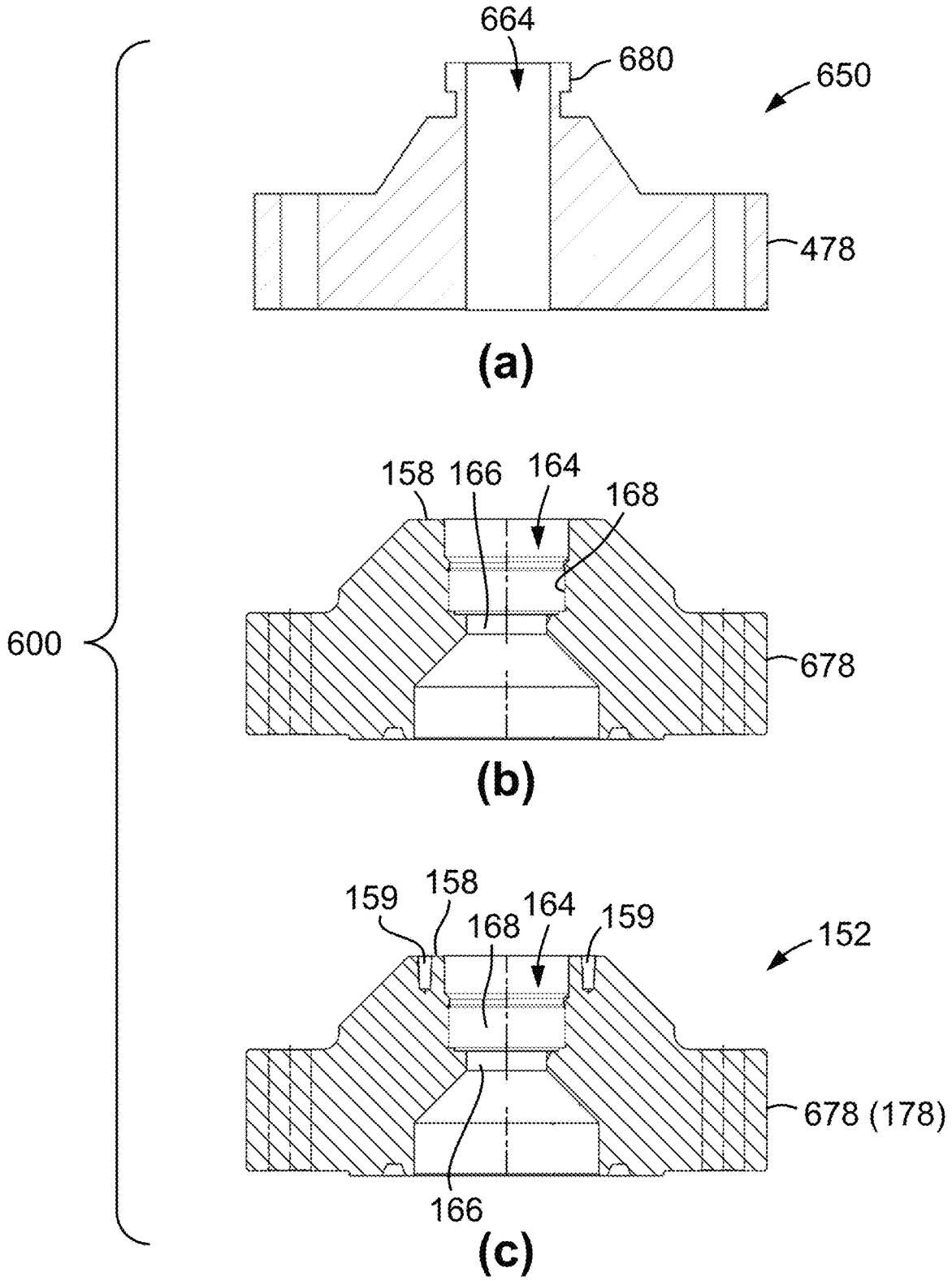
FIG. 25 is a set of side cross-sectional views of the steps of a method of converting an existing fluid coupling assembly for a manifold of a hydraulic fracturing system into a base of a fluid coupling assembly according to some embodiments of the disclosure.

An embodiment of method 600 of converting an existing fluid coupling assembly 650 for a manifold of a hydraulic fracturing system (such as the outlet manifold 100) into a base 152 that may engage with a coupling adapter 180 as described herein for the coupling assemblies 150 is shown in FIG. 25. Initially, the method 600 may start by providing the fluid coupling assembly 650 as shown at step (a) of FIG. 25. The fluid coupling assembly 650 may include a flange 678 and fluid coupling 680 that are formed as a single-piece monolithic body. A throughbore 664 extends through the fluid coupling assembly 650. The flange 478 may be engaged with a flow cross junction (such as the flow cross junction 130) of a manifold (such as the outlet manifold 100) as previously described for flange 178 of coupling assemblies 150 (FIG. 4). In addition, the fluid coupling 680 may be connected to an output of a pump of the hydraulic fracturing system (such as the pumps 44 of pumping units 40 shown in FIG. 1).

Next, method 600 may include removing the fluid coupling 680 from the fluid coupling assembly 650 and converting the throughbore 664 into the through-passage 164 as shown at step (b) of FIG. 25. For instance, in some embodiments, the fluid coupling 680 may be removed (such as cut, grinded, etc.) from the fluid coupling assembly 650 so as to form the outer end face 158 previously described above (FIG. 8). In addition, in some embodiments, converting the throughbore 664 into the through-passage 164 may include machining (such as cutting, milling, etc.) the surfaces of the throughbore 664 to form the shoulder 166, internal threads 168 and/or the other features and surfaces of through-passage 164 previously described above (FIG. 8).

Next, method 600 may include forming the mounting bores 159 in the outer end face 158 as shown in step (c) of FIG. 25. As previously described, the mounting bores 159 may receive the mounting members 212 to connect retainer ring 204 to the outer end face 158 (FIG. 8). The steps (a), (b), and (c) in FIG. 25 (alone or in combination with other manufacturing steps or processes) may result in a conversion of the monolithic fluid coupling assembly 650 into the base 152 of the fluid coupling assemblies 150 previously described (with the flange 678 forming the flange 178, previously described above). Thus, following step (c) of FIG. 25, the newly formed base 152 may threadably receive a coupling adapter 180 as shown in FIGS. 10 and 12-14 and as previously described above.

Figure 26:
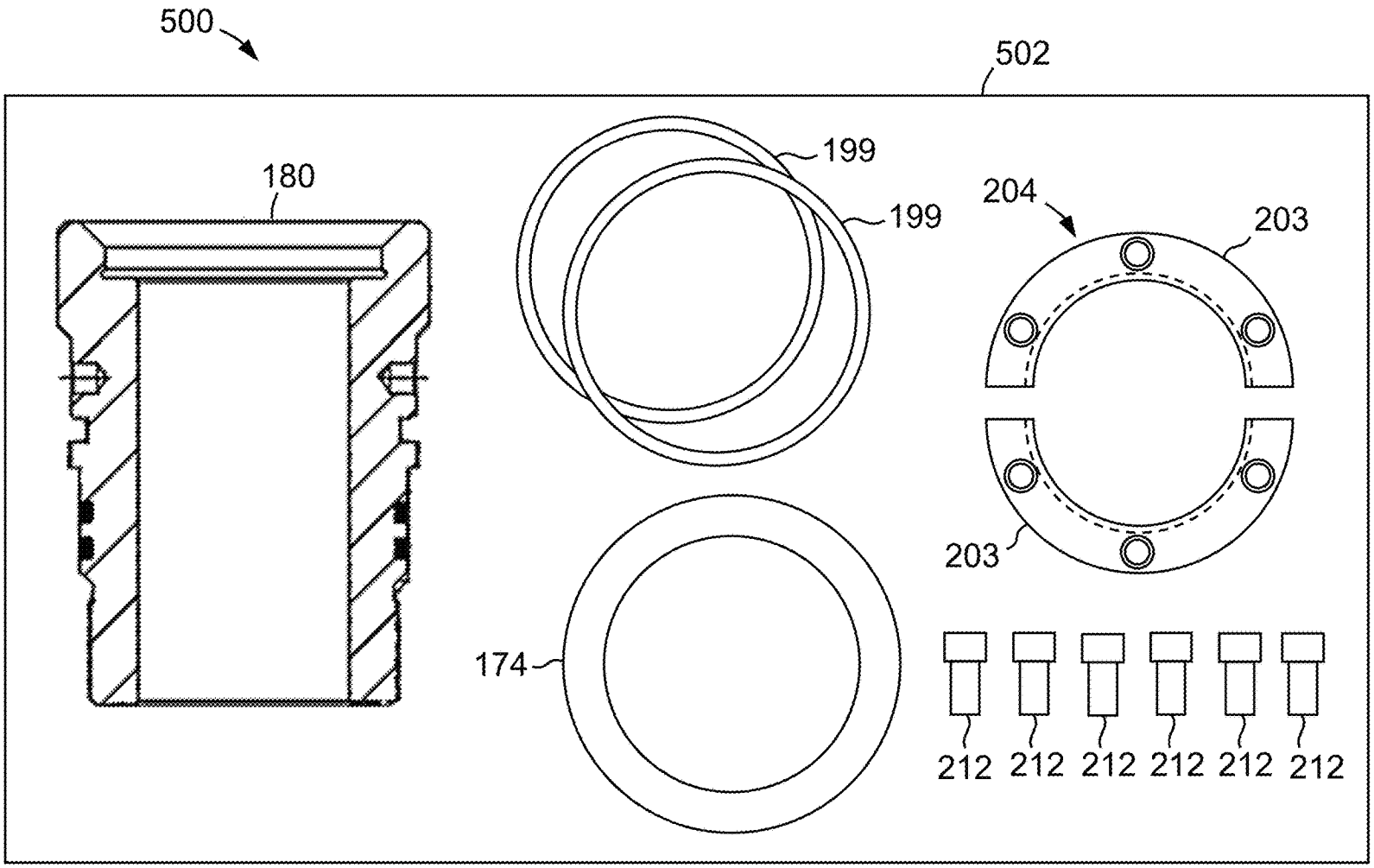
FIG. 26 is a schematic depiction of a kit including one or more components of a fluid coupling assembly according to some embodiments of the disclosure.

As shown in FIG. 26, in some embodiments, one or more components of the fluid coupling assembly 150 (FIGS. 5-7 and 10) may be transported to and about a hydraulic fracturing system (such as the hydraulic fracturing system 10 shown in FIG. 1) in a container 502 as a single kit or assembly 500. In some embodiments, the kit 500 may facilitate repair or replacement of one or more fluid coupling assemblies 150, or components thereof (FIGS. 5-10), so as to simplify the repair or replacement operation and minimize stoppage time for the hydraulic fracturing system (such as the hydraulic fracturing system 10 shown in FIG. 1).

In some embodiments the kit 500 may be used to replace a failed coupling adapter 180 on a base 152 of a coupling assembly 150 as previously described (FIG. 10). As a result, as shown in FIG. 26, the kit 500 may include coupling adapter 180, the one or more annular seal members 199, gasket 174, retainer ring 204, and the plurality of mounting members 212 for connecting retainer ring 204 to the base 152. In some embodiments, within the container 502, the annular seal members 199 may be seated within the annular seal grooves or recesses 198 formed on radially outer surface 180*c* of coupling adapter 180 to efficiently utilize the space in the container 502.

During operations, personnel may utilize kit 500 to replace a failed coupling adapter 180 on a base 152 of a fluid coupling assembly 150 described herein. Specifically, personnel may utilize the coupling adapter 180 within container 502 to replace the failed coupling adapter 180. In addition, the additional seal members 199 and gasket 174 may be used to replace the seal members 199 and gasket 174 that were utilized within the failed coupling adapter 180. Further, if necessary, the additional retainer ring 204 within the container 502 may be used to secure the replacement coupling adapter 180 to the base 152 if the original retainer ring 204 or any one or more of the mounting members 212 is damaged or lost before or during the removal of the failed coupling adapter 180.

It should be appreciated that, in some embodiments, the kit 500 may contain more or fewer components of embodiments of the fluid coupling assembly 150 described herein, as compared to the components shown in FIG. 26. For instance, in some embodiments, container 502 may include the coupling adapter 180, annular seal members 199 and gasket 174, but may omit the retainer ring 204, given that the original retainer ring 204 may be reused to secure the replacement coupling adapter 180 to the base 152 during operations. Still other combinations and sub-sets of components of embodiments of the fluid coupling assembly 150 are contemplated for inclusion within the container 502 (such as the base 152).

The container 502 may include any suitable container or support (such as the platform) for transporting the selected components of kit 500 to and about the hydraulic fracturing system (such as hydraulic fracturing system 10 in FIG. 1). In some embodiments, container 502 may include a box, crate, or similar container. In some embodiments, container 502 may include a pallet, frame, flatbed, or other support that may be moved about the hydraulic fracturing system 10 (such as via crane, forklift, truck, etc.). In some embodiments, one or more of the components positioned within container 502 may be positioned within additional sub-containers that are further positioned within container 502.

The embodiments disclosed herein include fluid couplings for a manifold of a hydraulic fracturing system that facilitate quick replacement in the event of a failure so as to minimize stoppage time. As previously described, in some embodiments, the embodiments disclosed herein include a fluid coupling assembly having a removable coupling adapter that is inserted within a base that is connected to the manifold. Thus, the coupling adapter may allow the component of the fluid coupling assembly with the highest likelihood of failure to be separately removed and replaced, thereby reducing the downtime associated with the fluid of a fluid coupling on the manifold. Accordingly, through use of the embodiments disclosed herein, a hydraulic fracturing operation may be conducted more safely and efficiently.

While some embodiments of the fluid coupling assemblies 150 described herein have been depicted to connect an output of a pump 44 to an outlet manifold 100 of a hydraulic fracturing system 10, it should be appreciated that in other embodiments, the fluid coupling assembly 150 may be used to fluidly connect other components of the hydraulic fracturing system to one another. In some embodiments, embodiments of the fluid coupling assembly 150 may be utilized to fluidly connect components within other oilfield systems (such as a drilling system, workover system, etc.). Thus, the use of fluid coupling assemblies 150 to connect the output of pumps 44 to outlet manifold 100 represent one potential use of the fluid coupling assemblies according to some embodiments.

In addition, while some embodiments of the fluid coupling assemblies 150 described herein include a coupling adapter 180 removably inserted within a through-passage 164 of a base 152 that is further connected to a flow cross junction 130 of the manifold 100, other embodiments may directly connect the fluid coupling assemblies 150 to a flow cross junction 130. For instance, in some embodiments, the coupling adapters 180 may be directly inserted within the inlet flow bores 134, 136 of the flow cross junction 130 (FIG. 4). Specifically, an internal shoulder (such as the internal shoulder 166) may be formed within the inlet flow bores 134 and coupling adapters 180 may be removably inserted into the inlet flow bores 134, 136 such that the coupling adapters 180 are compressed into the inlet flow bores 134, 136. The ends (such as the inner ends 180*b*) of each of the coupling adapters 180 may be compressed against the internal shoulders within the corresponding inlet flow bores 134, 136. In addition, retaining rings 204 may be engaged with external shoulders 194 of the coupling adapters 180 and connected to the radially outer surface 130*c* of the flow cross junction 130 so as to prevent (or restrict) rotation of the coupling adapters 180 within the corresponding inlet flow bores 134, 136 as previously described.

The preceding discussion is directed to various embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (such as a central axis of a body or a port), while the terms "radial" and "radially" generally mean perpendicular to the given axis. For instance, an axial distance refers to a distance measured along or parallel to the axis, and a radial distance means a distance measured perpendicular to the axis.

This application claims priority to, and the benefit of U.S. Provisional Application No. 63/512,219, filed Jul. 6, 2023, titled "FLUID COUPLING ASSEMBLIES FOR A MANIFOLD OF A HYDRAULIC FRACTURING SYSTEM AND RELATED METHODS," U.S. Provisional Application No. 63/512,193, filed Jul. 6, 2023, titled "FLOW CROSS JUNCTIONS FOR A MANIFOLD OF A HYDRAULIC FRACTURING SYSTEM AND RELATED METHODS," U.S. Provisional Application No. 63/491,139, filed Mar. 20, 2023, titled "FLOW CROSS JUNCTIONS FOR A MANIFOLD OF A HYDRAULIC FRACTURING SYSTEM AND RELATED METHODS," and U.S. Provisional Application No. 63/476,438, filed Dec. 21, 2022, titled "FLUID COUPLING ASSEMBLIES FOR A MANIFOLD OF A HYDRAULIC FRACTURING SYSTEM AND RELATED METHODS," the disclosures of which are incorporated herein by reference in their entireties. This application is also related to U.S. Non-Provisional application Ser. No. 18/545,963, filed Dec. 19, 2023, titled "FLOW CROSS JUNCTIONS FOR A MANIFOLD OF A HYDRAULIC FRACTURING SYSTEM AND RELATED METHODS," the disclosure of which is incorporated herein by reference in its entirety.

While some embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A fluid coupling assembly for a manifold of a hydraulic fracturing system, the fluid coupling assembly comprising:

a base to connect to an outer surface of the manifold, the base including a through-passage to fluidly connect to a flow path of the manifold, a coupling adapter removably inserted within the through-passage, the coupling adapter including a connection device and an external shoulder, the connection device to connect with an output of a pump of the hydraulic fracturing system; and a retainer ring connected to the base and compressed against the external shoulder to restrict a rotation of the coupling adapter within the through-passage.

2. The fluid coupling assembly of claim 1, wherein the retainer ring comprises a plurality of ring segments positioned circumferentially around the coupling adapter.

3. The fluid coupling assembly of claim 2, wherein the coupling adapter further includes an annular groove, wherein the external shoulder is located within the annular groove, and wherein the retainer ring comprises a projection located in the annular groove to engage the external shoulder.

4. The fluid coupling assembly of claim 3, wherein the coupling adapter further includes a plurality of engagement bores circumferentially spaced about the outer surface and positioned between the connection device and the annular groove along a central axis of the coupling adapter.

5. The fluid coupling assembly of claim 1, wherein the connection device comprises a set of external threads.

6. The fluid coupling assembly of claim 1, wherein the through-passage of the base comprises an internal shoulder, and wherein an end of the coupling adapter is compressed against the internal shoulder.

7. The fluid coupling assembly of claim 6, comprising a gasket positioned between the end of the coupling adapter and the internal shoulder within the through-passage.

8. A manifold of a hydraulic fracturing system, the manifold comprising:

an elongate manifold section;

a flow cross junction connected to the elongate manifold section; and a fluid coupling assembly connected to the flow cross junction, the fluid coupling assembly including:

a base including a first end, a second end opposite the first end, and a through-passage extending from the first end to the second end, the second end connected to the flow cross junction, and a coupling adapter including a connection device to connect to an output of a pump, the coupling adapter removably inserted into the through-passage from the first end to compress the coupling adapter into the through-passage and to position the connection device outside of the through-passage at the first end.

9. The manifold of claim 8, wherein the coupling adapter is inserted within the through-passage such that the coupling adapter is removable from the through-passage independent of a connection between the second end and the flow cross junction.

10. The manifold of claim 9, wherein the second end of the base includes a flange configured to be connected to the flow cross junction, and wherein the connection device comprises a set of external threads.

11. The manifold of claim 8, wherein the coupling adapter comprises an external shoulder, and wherein the fluid coupling assembly further comprises a retainer ring connected to the first end of the base such that the retainer ring is engaged with the external shoulder to restrict rotation of the coupling adapter within the through-passage.

12. The manifold of claim 11, wherein the retainer ring comprises a plurality of ring segments positioned circumferentially around the coupling adapter.

13. The manifold of claim 11, wherein the coupling adapter comprises an annular groove, wherein the external shoulder is positioned within the annular groove, and wherein the retainer ring comprises a projection inserted into the annular groove to engage the external shoulder.

14. The manifold of claim 13, wherein the coupling adapter comprises a plurality of engagement bores circumferentially spaced about an outer surface of the coupling adapter and positioned between the connection device and the annular groove along a central axis of the coupling adapter.

15. The manifold of claim 11, wherein the through-passage of the base comprises an internal shoulder, and wherein an end of the coupling adapter is compressed against the internal shoulder.

16. A method comprising:

(a) connecting an inner end of a base of a fluid coupling assembly to an outer surface of a manifold of a hydraulic fracturing system, the base including an outer end opposite the inner end and a through-passage extending from the outer end to the inner end; and (b) inserting a coupling adapter into the through-passage from the outer end to compress the coupling adapter into the through-passage and to position a connection device of the coupling adapter outside of the through-passage at the outer end.

17. The method of claim 16, wherein step (b) comprises compressing an end of the coupling adapter against an internal shoulder located within the through-passage.

18. The method of claim 17, wherein step (b) further comprises threading the coupling adapter into the through-passage.

19. The method of claim 16, further comprising:

(c) engaging a retainer ring with an external shoulder of the coupling adapter;

(d) connecting the retainer ring to the base; and (e) compressing the retainer ring against the external shoulder as a result of steps (c) and (d).

20. The method of claim 19, further comprising:

(f) restricting rotation of the coupling adapter within the through-passage with the retainer ring as a result of steps (c)-(e).

21. The method of claim 19, wherein step (c) further comprises inserting a projection connected to the retainer ring into an annular groove positioned on the coupling adapter, the external shoulder positioned within the annular groove, and the method further comprising (g) connecting an output of a hydraulic fracturing pump to the connection device of the coupling adapter after step (b).

22. The method of claim 21, wherein step (c) further comprises connecting a plurality of ring segments so as to define the retainer ring, wherein the connection device comprises a set of external threads, and wherein step (g) comprises threadably engaging a conduit connected to the output of the hydraulic fracturing pump with the set of external threads.

23. A method comprising:

(a) inserting a coupling adapter into a through-passage of a base of a fluid coupling assembly, the base connected to an outer surface of a manifold of a hydraulic fracturing system, and the coupling adapter including a connection device, thereby to connect to an output of a pump of the hydraulic fracturing system; and (b) engaging an external shoulder of the coupling adapter with a retainer ring to restrict a rotation of the coupling adapter within the through-passage.

24. The method of claim 23, further comprising connecting the retainer ring to the base.

25. The method of claim 23, further comprising:

(c) compressing an end of the coupling adapter against an internal shoulder located within the through-passage; and (d) connecting the output of a hydraulic fracturing pump to the connection device of the coupling adapter.

26. The method of claim 25, wherein the connection device comprises a set of external threads, and wherein (d) comprises threadably engaging a conduit connected to the output of the hydraulic fracturing pump with the set of external threads.

27. The method of claim 23, wherein the coupling adapter comprises a first coupling adapter, and the method further comprising:

(c) removing the first coupling adapter from the through-passage of the base of a fluid coupling assembly, the base including a first end and a second end opposite the first end, the second end being connected to a flow cross junction of a fluid manifold of a hydraulic fracturing system, and the through-passage positioned so as to extend from the first end to the second end; and (d) inserting a second coupling adapter into the through-passage from the first end to compress the second coupling adapter into the through-passage and to position a connection device of the second coupling adapter outside of the through-passage at the first end.

28. The method of claim 27, further comprising maintaining a connection between the second end and the flow cross junction during steps (c) and (d).

29. The method of claim 28, wherein step (d) comprises compressing an end of the second coupling adapter against an internal shoulder located within the through-passage, and the method further comprising (e) connecting an output of a hydraulic fracturing pump to the connection device of the second coupling adapter after step (d).

30. The method of claim 29, further comprising:

(f) engaging a retainer ring with an external shoulder of the second coupling adapter;

(g) connecting the retainer ring to the base; and (h) compressing the retainer ring against the external shoulder as a result of steps (f) and (g).

* * * * *